US010655268B2

(12) United States Patent
Jung et al.

(10) Patent No.: US 10,655,268 B2
(45) Date of Patent: May 19, 2020

(54) LAUNDRY TREATMENT APPARATUS AND METHOD OF CONTROLLING THE SAME

(71) Applicant: LG ELECTRONICS INC., Seoul (KR)

(72) Inventors: Jonegseok Jung, Seoul (KR); Hyunsang Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 72 days.

(21) Appl. No.: 15/723,347

(22) Filed: Oct. 3, 2017

(65) Prior Publication Data

US 2018/0245268 A1 Aug. 30, 2018

Related U.S. Application Data

(63) Continuation of application No. 15/638,284, filed on Jun. 29, 2017.

(30) Foreign Application Priority Data

Feb. 27, 2017 (KR) ..... 10-2017-0025737

(51) Int. Cl.
*D06F 39/14* (2006.01)
*D06F 33/02* (2006.01)
(Continued)

(52) U.S. Cl.
CPC ..... *D06F 39/14* (2013.01); *A47L 15/4214* (2013.01); *A47L 15/44* (2013.01);
(Continued)

(58) Field of Classification Search
None
See application file for complete search history.

(56) References Cited

U.S. PATENT DOCUMENTS

2003/0200774 A1* 10/2003 Kim ..... D06F 17/06 68/133
2009/0013729 A1* 1/2009 Park ..... D06F 39/008 68/16

(Continued)

FOREIGN PATENT DOCUMENTS

CN 101451294 6/2009
CN 103243518 8/2013

(Continued)

OTHER PUBLICATIONS

Extended European Search Report in European Application No. 17190280.2, dated Feb. 26, 2018, 10 pages.

(Continued)

*Primary Examiner* — Cristi J Tate-Sims
(74) *Attorney, Agent, or Firm* — Fish & Richardson P.C.

(57) ABSTRACT

A laundry treatment apparatus includes a cabinet having first and second washing apparatuses that treat laundry introduced through a front opening and through a top opening, respectively. The second washing apparatus includes: a tub that holds water and has an opening at a top that is accessible through the second opening; a drum inside the tub that rotates about a vertical shaft; an agitation unit protruding upward from a center bottom surface of the drum that agitates water and laundry inside the rotating drum; a heater that heats water in the tub; a water supply valve controlling a flow of water into the tub; and at least one processor that controls the heater to heat a first amount of water in the tub to a first temperature; and controls the water supply valve to additionally supply, to the first amount of water, incremental amounts of water to into the tub.

20 Claims, 13 Drawing Sheets

(51) Int. Cl.

| | |
|---|---|
| ***A47L 15/42*** | (2006.01) |
| ***A47L 15/44*** | (2006.01) |
| ***D06F 39/02*** | (2006.01) |
| ***D06F 39/08*** | (2006.01) |
| *D06F 31/00* | (2006.01) |
| *A47L 15/00* | (2006.01) |
| *D06F 39/00* | (2020.01) |

(52) U.S. Cl.
CPC ..... *D06F 33/02* (2013.01); *D06F 39/022* (2013.01); *D06F 39/028* (2013.01); *D06F 39/08* (2013.01); *A47L 15/00* (2013.01); *D06F 31/00* (2013.01); *D06F 39/00* (2013.01); *D06F 2202/04* (2013.01); *D06F 2204/086* (2013.01)

(56) References Cited

U.S. PATENT DOCUMENTS

| | | | | |
|---|---|---|---|---|
| 2010/0307200 | A1* | 12/2010 | Jeong | D06F 31/00 68/13 R |
| 2014/0208522 | A1 | 7/2014 | Oh et al. | |
| 2014/0208523 | A1* | 7/2014 | Kim | D06F 39/008 8/137 |
| 2015/0184326 | A1 | 7/2015 | Seo et al. | |
| 2016/0215432 | A1 | 7/2016 | Kim | |

FOREIGN PATENT DOCUMENTS

| | | | |
|---|---|---|---|
| CN | 106149311 | | 11/2016 |
| DE | 3935416 | | 4/1991 |
| EP | 424780 | A2 | 5/1991 |
| EP | 1354996 | | 4/2006 |
| EP | 2949807 | A2 | 12/2015 |
| JP | 2003311063 | | 11/2003 |
| KR | 10-2012-0073586 | | 7/2012 |
| KR | 10-2016-0007458 | | 1/2016 |
| KR | 10-2016-0092453 | | 8/2016 |
| WO | WO2012150539 | A2 | 11/2012 |
| WO | WO2015082281 | A2 | 6/2015 |

OTHER PUBLICATIONS

Australian Office Action in Australian Application No. 2017204361, dated May 31 2018, 6 pages.
United States Office Action in U.S. Appl. No. 15/638,284, dated May 2, 2019, 23 pages.
Chinese Office Action in Chinese Application No. 201711102868.2, dated Jan. 6, 2020, 24 pages (with English translation).

* cited by examiner

LAUNDRY TREATMENT APPARATUS AND METHOD OF CONTROLLING THE SAME

CROSS-REFERENCE TO RELATED APPLICATIONS

This application is a continuation of U.S. application Ser. No. 15/638,284, filed on Jun. 29, 2017, which claims the benefit of an earlier filing date and right of priority to Korean Patent Application No. 10-2017-0025737, filed on Feb. 27, 2017. The disclosures of the prior applications are incorporated by reference in their entirety.

TECHNICAL FIELD

The present disclosure generally relates to a laundry treatment apparatus and a method of controlling the same.

BACKGROUND

Generally, a laundry treatment apparatus is an apparatus that washes and/or dries laundry. The laundry treatment apparatus typically performs either a washing function or a drying function. Some laundry treatment apparatuses perform both a washing function and a drying function. In addition, some washing machines include a steam supply device to perform a refreshing function, such as removing wrinkles, smells, and static electricity from laundry.

Laundry treatment apparatuses are typically classified as a front loading type laundry treatment apparatus or a top loading type laundry treatment apparatus, depending on a direction in which laundry is loaded. An example of a front loading type laundry treatment apparatus is a drum washing machine or a drum drying machine.

A front loading type laundry treatment apparatus is a laundry treatment apparatus configured such that an opening is formed in the front of the laundry treatment apparatus, with a shaft of a drum being parallel to the ground or inclined relative thereto at an angle. A top loading type laundry treatment apparatus is a laundry treatment apparatus configured such that an opening is formed in the top of the laundry treatment apparatus, with a shaft of a drum being perpendicular to the ground.

SUMMARY

Implementations disclosed herein provide a laundry treatment apparatus that includes both a front-loading first washing apparatus and a top-loading second washing apparatus, where the top-loading second washing apparatus is provided with an agitation unit inside a tub, and is configured to incrementally heat and supply water into the tub.

In one aspect, a laundry treatment apparatus may include a cabinet having a first opening and a second opening; a first cabinet door and a second cabinet door provided at the cabinet and configured to open and close the first opening and the second opening, respectively; a first washing apparatus provided in the cabinet and configured to treat laundry that is introduced from a front side of the first washing apparatus through the first opening; and a second washing apparatus configured to treat laundry introduced from an upper side of the second washing apparatus through the second opening. The second washing apparatus may include: a tub configured to hold water and having an opening at a top of the tub that is accessible through the second opening of the cabinet; a tub cover arranged on the tub and provided to cover the top of the tub, the tub cover defining an introduction port through which an inside of the tub is accessible; a tub door provided at the tub cover and configured to open and close the introduction port of the tub cover separately from the second cabinet door opening and closing the second opening of the cabinet; a drum provided inside the tub and configured to rotate about a vertical shaft; an agitation unit that protrudes upward from a center part of a bottom surface of the drum and that is configured to agitate water and laundry inside the drum in a state in which the drum rotates about the vertical shaft; a heater configured to heat water in the tub; a water supply pipe configured to supply water to the tub; a water supply valve configured to control a flow through the water supply pipe. The second washing apparatus may also include at least one processor configured to, in a state in which the introduction port is closed by the tub door, control the water supply valve and the heater by: controlling the heater to heat a first amount of water in the tub to a first temperature; and controlling the water supply valve to additionally supply, to the first amount of water, incremental amounts of water into the tub.

In some implementations, the second washing apparatus may be arranged above the first washing apparatus and may be configured with a second washing capacity that is smaller than a first washing capacity of the first washing apparatus.

In some implementations, controlling the water supply valve to supply the incremental amounts of water into the tub of the second washing apparatus may include: controlling the water supply valve to provide a supply of water through the water supply pipe into the tub for a first amount of time; and controlling the water supply valve to interrupt the supply of water through the water supply pipe into the tub for a second amount of time.

In some implementations, the second amount of time may be longer than the first amount of time.

In some implementations, controlling the water supply valve to supply the incremental amounts of water into the tub of the second washing apparatus may include: controlling the water supply valve to alternate, a plural number of times, between providing the supply of water through the water supply pipe into the tub for the first amount of time and controlling the water supply valve to interrupt the supply of water through the water supply pipe into the tub for the second amount of time.

In some implementations, the at least one processor may be further configured to: after controlling the water supply valve to supply the incremental amounts of water into the tub of the second washing apparatus: control the water supply valve to additionally supply a second amount of water into the tub of the second washing apparatus; and control the second washing apparatus to rotate the drum inside the tub based on the second amount of water being added into the tub.

In some implementations, the first amount of water added into the tub may result in a first water level in the tub at which a portion of the agitation unit is immersed below the first water level and an uppermost end of the agitation unit is exposed above the first water level, and the second amount of water added into the tub may result in a second water level in the tub at which the uppermost end of the agitation unit is immersed below the second water level.

In some implementations, controlling the heater to heat the first amount of water in the tub of the second washing apparatus to the first temperature may include: heating the water at the first water level in the tub to a highest temperature among available water temperature setting values provided by the laundry treatment apparatus.

In some implementations, the agitation unit may include a first surface that is exposed to an interior of the drum of the second washing apparatus, the first surface being plated with a first material.

In some implementations, the laundry treatment apparatus may further include: a water level sensor configured to sense a level of water in the tub of the second washing apparatus. The at least one processor may be further configured to: control the water supply valve to supply water into the tub at a first rate until a first time at which an uppermost end of the agitation unit is immersed below a water level of the tub; and after the first time, control the water supply valve to supply water into the tub at a second rate less than the first rate.

In some implementations, the laundry treatment apparatus may further include: a temperature sensor configured to sense a temperature in the tub of the second washing apparatus. The at least one processor may be configured to: control the water supply valve to supply water into the tub at a first rate until a first time at which a temperature sensed by the temperature sensor satisfies a first condition; and after the first time, control the water supply valve to supply water into the tub at a second rate less than the first rate.

In some implementations, the at least one processor may be further configured to control the water supply valve and the heater by: while controlling the water supply valve to supply the incremental amounts of water into the tub, intermittently controlling the heater to heat the incremental amounts of water that are added into the tub.

In some implementations, the at least one processor may be further configured to control the water supply valve and the heater by: controlling the water supply valve to supply a first incremental amount of water into the tub; controlling the heater to heat the water in the tub; detecting that a temperature of the water in the tub is heated to a first temperature; and based on detecting that the temperature of the water in the tub is heated to the first temperature, controlling the water supply valve to supply a second incremental amount of water into the tub.

In some implementations, the agitation unit may be composed of a first material that is different than a second material of the drum.

In some implementations, the agitation unit may include a surface that is plated with a third material having a third coefficient of thermal expansion that is different from a first coefficient of thermal expansion of the first material of the agitation unit.

In some implementations, the water supply pipe may be configured to supply water having a second temperature that is lower than the first temperature to which the first amount of water in the tub is heated by the heater.

In some implementations, the agitation unit may be fixedly coupled to the bottom surface of the drum of the second washing apparatus.

In some implementations, the agitation unit may be configured to rotate in conjunction with a rotation of the drum of the second washing apparatus.

In some implementations, the agitation unit may be configured to rotate independently of a rotation of the drum of the second washing apparatus.

In some implementations, the drum of the second washing apparatus may be a second drum of the laundry treatment apparatus, and the first washing apparatus may further include a first drum configured to rotate about a horizontal shaft.

It is to be understood that both the foregoing general description and the following detailed description are merely exemplary and explanatory and are intended to provide further explanation of the present invention as claimed.

DETAILED DESCRIPTION

Figure 1A:
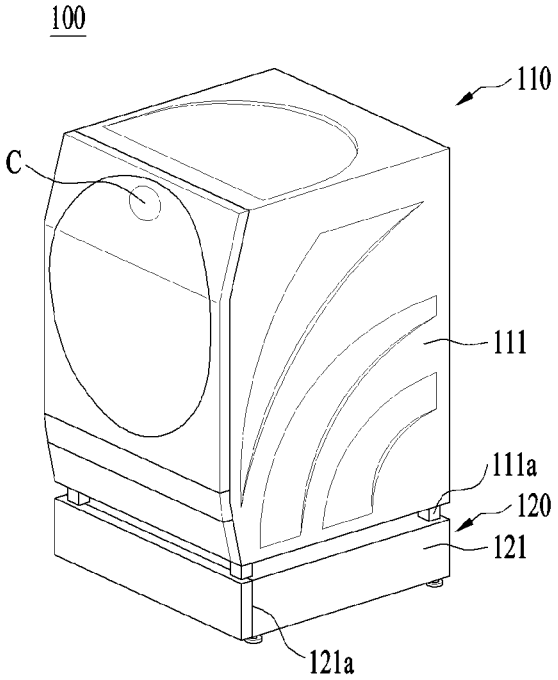
FIGS. 1A to 1C are diagrams illustrating examples of various laundry treatment apparatuses according to some implementations.

In recent years, the sizes of laundry treatment apparatuses have increased in response to the demands of users. In many scenarios, a single large-capacity laundry treatment apparatus is utilized in a home. When different types of laundry are to be sorted and washed, therefore, the laundry treatment apparatus is repeatedly used several times. For example, when larger items such has adult clothes and smaller items such as underwear or baby clothes are to be separately washed, a laundry treatment apparatus is often used to separately wash each type of laundry. As a result, washing time is increased, and power consumption is also increased.

Using a large-sized laundry treatment apparatus to wash a small amount of laundry is often not preferable in terms of energy savings. Since a washing course set in the large-sized laundry treatment apparatus is generally used to wash a large amount of laundry, water consumption may be high. In addition, power consumption to rotate a large-sized drum also may be high. Furthermore, typical laundry cycles of large-capacity machines have longer washing times.

In addition, since the washing cycle in large-sized laundry treatment apparatuses is mainly used for general clothes, such large-sized laundry treatment apparatuses may not be suitable for washing delicate clothes, such as underwear or baby clothes. Furthermore, a large-sized laundry treatment apparatus may not be suitable for frequently washing small amounts of laundry, even though users may prefer washing smaller loads more frequently.

For at least these reasons, in some scenarios, a small-sized laundry treatment apparatus having a smaller capacity may be preferable over a large-sized laundry treatment apparatus.

In some implementations, a combination-type laundry treatment apparatus may include both a small-sized laundry treatment apparatus and a large-sized laundry treatment apparatus. The small-sized laundry treatment apparatus may have a relatively small volume. Even when a small amount of water is supplied into a tub, therefore, the bottom surface of a drum may easily contact the water.

In scenarios where the small-sized laundry treatment apparatus is configured as a top-loading type laundry treatment apparatus, an agitation unit may be provided at the bottom surface of the drum to contact water. The agitation unit may protrude from the bottom surface of the drum and may be configured to agitate laundry as the laundry rotates within the tub, thus improving cleaning performance.

However, in some scenarios, the presence of an agitation unit at the bottom surface of the drum may cause difficulties when hot water is introduced into the drum. In such scenarios, the hot water may cause damage to an agitation unit.

For example, such difficulties may arise when water in a tub is heated using a heater in the small-sized laundry treatment apparatus. In such scenarios, the water may be heated to a high temperature in the state in which a small amount of hot water is first supplied into the tub, followed by additionally supplying lower-temperature water to achieve the desired final temperature.

However, when an initial amount of hot water is supplied in the small-sized laundry treatment apparatus, the agitation unit generally comes into contact with the water at the bottom of the tub. If the initially supplies water is heated, then the agitation unit is also heated. Subsequently, when lower-temperature water is supplied, the temperature of the heated agitation unit and the heated water is lowered to a desired final temperature.

When the agitation unit contacts additionally supplied water having a low temperature in the state in which the temperature of the agitation unit is high, however, the agitation unit abruptly undergoes thermal shrinkages, with the result that the agitation unit may be damaged.

In the case in which the agitation unit is made of materials having different coefficients of thermal expansion or in the case in which the surface of the agitation unit is plated with a metal material having a different coefficient of thermal expansion than the interior of the agitation unit, the agitation unit may be damaged by an abrupt change in temperature.

In addition, the interior of the small-sized laundry treatment apparatus is substantially sealed in order to prevent wash water or bubbles from being discharged to the outside during washing. In a course including heating, therefore, environmental changes in the small-sized laundry treatment apparatus may be large. For example, in a heated state, in which water is heated to the highest temperature, the change in temperature and pressure in the tub and the drum may be large. In such scenarios, there may result an abrupt change in temperature and pressure in the drum. Such an abrupt change in temperature may damage the agitation unit and such an abrupt change in pressure may instantaneously generate negative pressure in the sealed tub, which may cause many problems.

Implementations disclosed herein may, in some scenarios, address the difficulties described above.

In some implementations, a laundry treatment apparatus is configured to reduce damage to components in the laundry treatment apparatus while heating water in the tub. In particular, the laundry treatment apparatus may be configured to reduce damage to an agitation unit during heating of water in the tub.

In some implementations, a laundry treatment apparatus is configured to mitigate an abrupt change in temperature of an agitation unit, thereby reducing damage to the agitation unit. As such, even if the agitation unit is made of materials having different coefficients of thermal expansion or includes parts having different coefficients of thermal expansion, damage may be reduced to the agitation unit.

In some implementations, a laundry treatment apparatus is configured to perform iterated, stepwise cooling of an agitation unit after the agitation unit is heated. As such, even when the agitation unit is heated to a high temperature, damage may be reduced by avoiding sudden changes in temperature.

In some implementations, a laundry treatment apparatus is configured to mitigate abrupt negative pressure from being generated in a tub. The laundry treatment apparatus may be configured to mitigate abrupt negative pressure from being generated in a tub irrespective of the temperature of water supplied from the outside.

In some implementations, a laundry treatment apparatus is configured to heat wash water and perform a washing cycle. In some implementations, a laundry treatment apparatus is configured to mitigate occurrences of a door being deformed or opened by negative pressure in a tub. In some implementations, a laundry treatment apparatus is configured to mitigate instantaneously high negative pressure from being generated in a tub. The laundry treatment apparatus may be configured to mitigate instantaneously abrupt negative pressure from being generated in a tub due to the amount of air being greater than the amount of air flowing per unit time between the inside and the outside of the tub.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

In accordance with some implementations, a laundry treatment apparatus includes a cabinet defining the external appearance thereof, a tub provided in the cabinet for storing water, a drum rotatably provided in the tub for receiving laundry, an agitation unit provided at the bottom surface of the drum so as to agitate the laundry, a heater for heating the water in the tub, a water supply pipe for supplying water to the tub, a water supply valve for opening and closing the water supply pipe, a drainage pump for draining the water from the tub, and a controller for performing control such that the water supply valve is opened until at least a portion of the agitation unit is exposed, the heater is operated to heat the water in the tub, and the water supply valve is intermittently opened when the operation of the heater is completed.

The cabinet may be provided in the upper part thereof with an opening, and the width of the drum may be greater than the height of the drum.

The agitation unit may be made of a different material than the drum.

The surface of the agitation unit may be plated with a material having a different coefficient of thermal expansion than the agitation unit.

The controller may perform control such that the water supply valve is intermittently opened until the agitation unit is immersed in water.

The controller may perform control such that the opening time of the water supply valve is shorter than the closing time of the water supply valve when the water supply valve is intermittently opened.

Upon sensing that the entirety of the agitation unit is immersed in water, the controller may perform control such that the water supply valve is continuously open.

Upon sensing that the entirety of the agitation unit is immersed in water, the controller may perform control so as to change the cycle at which or the time for which the water supply valve is opened and closed.

Upon sensing that the level of water in the tub is a level at which the laundry in the drum can be washed, the controller may perform control such that the water supply valve is closed.

The laundry treatment apparatus may further include a temperature sensor for sensing the temperature in the tub, wherein, upon determining that the temperature in the tub sensed using the temperature sensor before the agitation unit is immersed in water is lower than a specific temperature, the controller may perform control so as to continuously open the water supply valve or to change the cycle at which or the time for which the water supply valve is intermittently opened.

Upon sensing that the heater is exposed to air before the heater is operated, the controller may perform control such that the water supply valve is opened. Upon sensing that the entirety of the agitation unit is immersed in water before the heater is operated, the controller may perform control such that the drainage pump is operated.

The laundry treatment apparatus may further include a driving unit for rotating the drum, wherein the controller may perform control such that the driving unit is operated when the water supply valve is intermittently opened.

The laundry treatment apparatus may further include a spray nozzle provided in the end of the water supply pipe for spraying water, wherein the controller may perform control such that water is supplied into the tub through the spray nozzle when the water supply valve is intermittently opened.

The laundry treatment apparatus may further include a spray nozzle separately provided in the water supply pipe for spraying water into the tub, wherein the controller may perform control such that water is supplied into the tub through the spray nozzle when the water supply valve is intermittently opened.

The laundry treatment apparatus may further include a water level sensor for sensing the level of water in the tub, wherein the controller may perform control such that the level of water in the tub is sensed through the water level sensor.

The laundry treatment apparatus may further include a first laundry receiving unit provided in the upper part or the lower part of the tub for receiving laundry.

The first laundry receiving unit may include a first tub provided separately from the tub for storing water and a first drum rotatably provided in the first tub.

In accordance with some implementations, a laundry treatment apparatus includes a cabinet defining the external appearance thereof, a tub provided in the cabinet for storing water, the tub being provided in the upper part thereof with an introduction port, through which laundry is introduced, a drum rotatably provided in the tub for receiving laundry, a door for opening and closing the introduction port, an agitation unit protruding upward from a center part of the bottom surface of the drum so as to agitate the water and the laundry as the laundry rotates around the agitator, a heater for heating the water in the tub, a water supply pipe connected to an external water supply source for supplying water to the tub, a water supply valve for opening and closing the water supply pipe, and a controller for controlling the operation of the water supply valve and the operation of the heater in the state in which the introduction port is closed by the door, wherein the controller controls the operation of the heater such that the water in the tub is heated to a boiling temperature at a boiling level and then controls the operation of the water supply valve such that the water supply valve supplies water through intermittent water supply to stepwise alleviate environmental changes caused by the operation of the heater.

In accordance with some implementations, a method of controlling a laundry treatment apparatus, including a tub for storing wash water, a drum provided in the tub for receiving laundry, an introduction port formed in the upper part of the tub for allowing laundry to be introduced therethrough, and a door for opening and closing the introduction port, includes heating the water stored in the tub in the state in which the introduction port is closed by the door to boil the laundry in a high-temperature, high-humidity environment (a boiling step), intermittently supplying water to the tub to stepwise alleviate environmental changes caused at the boiling step (an alleviation step), and agitating the laundry in the drum in the alleviated environment to perform washing (a washing step).

In accordance with some implementations, a laundry treatment apparatus includes a cabinet having a first opening and a second opening, a first cabinet door and a second cabinet door provided at the cabinet for opening and closing the first opening and the second opening, respectively, a first washing apparatus provided in the cabinet for treating laundry introduced from the front after the first cabinet door is opened, and a second washing apparatus for treating laundry introduced from above after the second cabinet door is opened, wherein the second washing apparatus includes a tub provided so as to be accessible after the second opening is opened through the second cabinet door, the tub being configured to store water, the upper part of the tub being open, a tub cover located at the upper part of the tub for covering the upper part of the tub, the tub cover being provided with an introduction port, through which laundry is introduced, a tub door provided at the tub cover for opening and closing the introduction port, the tub door being configured to be manipulated by a user independently of the second cabinet door, a drum provided in the tub so as to be rotatable about a vertical shaft, an agitation unit protruding upward from a center part of the bottom surface of the drum so as to agitate the water and the laundry while the laundry rotates around the agitator, a heater for heating the water in the tub, a water supply pipe connected to an external water supply source for supplying water to the tub, a water supply valve for opening and closing the water supply pipe, and a controller for controlling the operation of the water supply valve and the operation of the heater in the state in which the introduction port is closed by the tub door, and wherein the controller controls the operation of the heater such that the water in the tub is heated to a boiling temperature at a boiling level and then controls the operation of the water supply valve such that the water supply valve supplies water through intermittent water supply to stepwise alleviate environmental changes caused by the operation of the heater.

In accordance with some implementations, a method of controlling a laundry treatment apparatus, including a tub for storing wash water, an introduction port provided in the upper surface of the tub, and a door for opening and closing the introduction port, includes a washing course selection step of selecting a heating course in which laundry is heated, a water supply step of supplying water to the tub, a heating step of heating the water stored in the tub, a negative pressure prevention step of performing intermittent water supply to supply water into the tub for a first predetermined amount of time and to interrupt the supply of water for a second predetermined amount of time, a washing water supply step of supplying water to a washing level for washing after the negative pressure prevention step, and a main washing step.

Hereinafter, some examples of implementations will be described in detail with reference to the accompanying drawings. In some implementations, the configuration of an apparatus or a control method of the apparatus, which will be described below, is merely given to describe some examples, without being intended to limit the scope of the present disclosure.

Figure 1B:
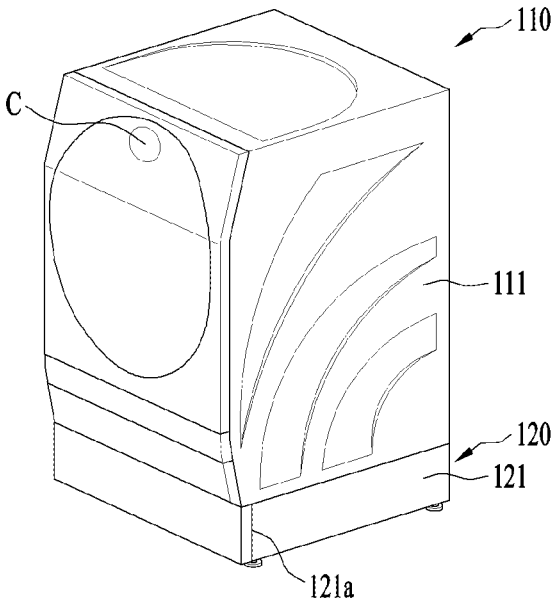
Figure 1C:
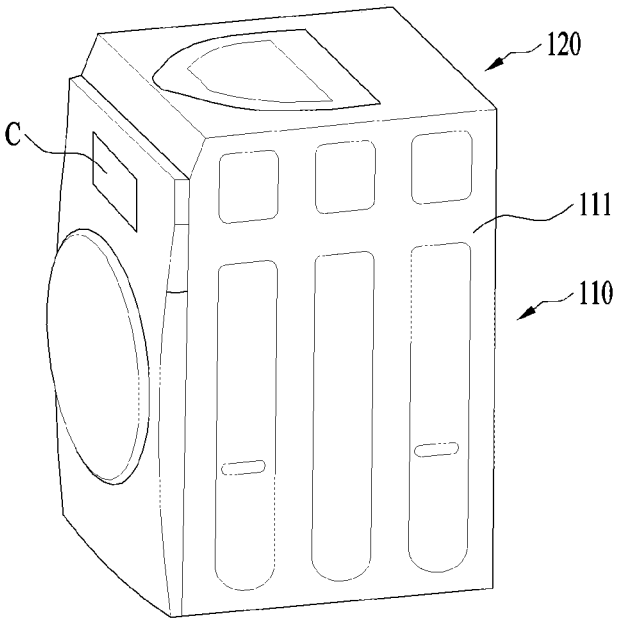

FIGS. 1A to 1C are diagrams showing examples of implementations of a laundry treatment apparatus. The implementations of the laundry treatment apparatus may commonly include a first washing apparatus 110, which is a main laundry treatment apparatus, and a second washing apparatus 120, which is an auxiliary laundry treatment apparatus.

Alternatively, the laundry treatment apparatus may not include both the first washing apparatus 110 and the second washing apparatus 120. That is, the laundry treatment apparatus may include either the first washing apparatus 110 or the second washing apparatus 120.

The laundry treatment apparatus will be described as including a plurality of processing units merely for convenience of description, and the case in which the laundry treatment apparatus includes a single processing unit is not excluded.

The first washing apparatus 110 may be configured as a washer for performing a washing cycle to remove foreign matter from laundry or as a dryer for performing a drying cycle to remove moisture from laundry. Even in the case in which the first washing apparatus 110 is configured as a washer, the first washing apparatus 110 may perform a drying cycle to dry laundry.

The second washing apparatus 120 may be configured as a washer for performing a washing cycle to remove foreign matter from laundry or as a dryer for performing a drying cycle to remove moisture from laundry. Even in the case in which the second washing apparatus 120 is configured as a washer, the second washing apparatus 120 may perform a drying cycle to dry laundry.

The first washing apparatus 110 may have a larger size than the second washing apparatus 120 so as to have a larger washing or drying capacity than the second washing apparatus 120.

The reason for this is that it is necessary for the second washing apparatus 120 to rapidly wash or dry underwear, baby clothes, or a small amount of laundry while saving energy.

The second washing apparatus 120 may be separably coupled to the first washing apparatus 110 (see FIG. 1A) or may be integrated into the first washing apparatus 110 (see FIGS. 1B and 1C).

Referring to FIG. 1A, the second washing apparatus 120 may be separably coupled to the first washing apparatus 110 in order to constitute a single laundry treatment apparatus.

In the case in which the second washing apparatus 120 is configured to be separated from the first washing apparatus 110, the first washing apparatus 110 may include a first cabinet 111 that defines the external appearance thereof, and the second washing apparatus 120 may include a second cabinet 121 that defines the external appearance thereof, the second cabinet 121 being distinguished from the first cabinet 111.

The second washing apparatus 120 may be provided under the first washing apparatus 110.

Additionally, in the case in which the second washing apparatus 120 is configured to be separated from the first washing apparatus 110 but is provided together with the first washing apparatus 110, the second washing apparatus 120 may be disposed on, under, or beside the first washing apparatus 110.

The first washing apparatus 110 may be configured as a front loading type laundry treatment apparatus, and the second washing apparatus 120 may be configured as a top loading type laundry treatment apparatus.

In this case, the second washing apparatus 120 may be configured as a drawer type laundry treatment apparatus in order to avoid interference with the front loading type laundry treatment apparatus.

That is, the second washing apparatus 120 may include a drawer 121*a* configured to be withdrawn forward from the second cabinet 121 and a laundry receiving unit defined in the drawer 121*a* for receiving laundry.

In some implementations, since the first washing apparatus 110 is located on the second washing apparatus 120, the first cabinet 111 of the first washing apparatus 110 may be provided at the lower surface thereof with a plurality of connection parts 111*a* configured to be located on the second cabinet 112 of the second washing apparatus 120, and the second cabinet 112 of the second washing apparatus 120 may be provided in the upper surface thereof with recesses, into which the connection parts 111*a* are received and located.

In some implementations, when the second washing apparatus 120 is coupled to the first washing apparatus 110, a controller provided in any one selected from between the first washing apparatus 110 and the second washing apparatus 120 may be configured to control both the first washing apparatus 110 and the second washing apparatus 120.

To this end, the connection parts 111*a* may be configured as connectors for transmitting an electrical signal between the first washing apparatus 110 and the second washing apparatus 120.

In some implementations, the second washing apparatus 120 may be configured to operate only when the first washing apparatus 110 is located on the second washing apparatus 120 in order to prevent the second washing apparatus 120 from overturning when the drawer 121*a* is withdrawn.

The first washing apparatus 110 may be provided with a control panel C for displaying the status of the first washing apparatus 110 and the second washing apparatus 120 and allowing a user to input an operation command to the first washing apparatus 110 and the second washing apparatus 120.

Unlike what is shown in FIG. 1A, the first washing apparatus 110 may be configured as a top loading type laundry treatment apparatus, and the second washing apparatus 120 may be configured as a front loading type laundry treatment apparatus. Furthermore, the second washing apparatus 120 may be disposed on, under, or beside the first washing apparatus 110.

FIGS. 1B and 1C show implementations in which a first washing apparatus 110 and a second washing apparatus 120 are integrated into a single body.

FIGS. 1B and 1C show the case in which the first washing apparatus 110 is configured as a top loading type laundry treatment apparatus and the second washing apparatus 120 is configured as a front loading type laundry treatment apparatus. FIG. 1B shows the case in which the second washing apparatus 120 is disposed under the first washing apparatus 110, and FIG. 1C shows the case in which the second washing apparatus 120 is disposed on the first washing apparatus 110.

Referring to FIG. 1B, a first cabinet 111 that defines the external appearance of the first washing apparatus 110 and a second cabinet 121 that defines the external appearance of the second washing apparatus 120 may be coupled to each other in order to constitute a single body.

In order to avoid interference with the first washing apparatus 110, the second washing apparatus 120 may include a drawer 121*a* configured to be withdrawn forward from the second cabinet 121 and a laundry receiving unit defined in the drawer 121*a* for receiving laundry.

The first cabinet 111 may be provided with a control panel C for displaying the status of the first washing apparatus 110 and the second washing apparatus 120 and allowing a user to input an operation command to the first washing apparatus 110 and the second washing apparatus 120.

Since the first washing apparatus 110 is disposed on the second washing apparatus 120, the control panel C may be provided at the first cabinet 111 of the first washing apparatus 110.

Referring to FIG. 1C, the first washing apparatus 110 and the second washing apparatus 120 may be provided in a single cabinet 111 that defines the external appearance thereof.

The cabinet 111 may be provided with a control panel C for displaying the status of the first washing apparatus 110 and the second washing apparatus 120 and allowing a user to input an operation command to the first washing apparatus 110 and the second washing apparatus 120.

Since the second washing apparatus 120 is disposed on the first washing apparatus 110, the control panel C may be provided at the portion of the first cabinet 111 in which the second washing apparatus 120 is located.

Figure 2:
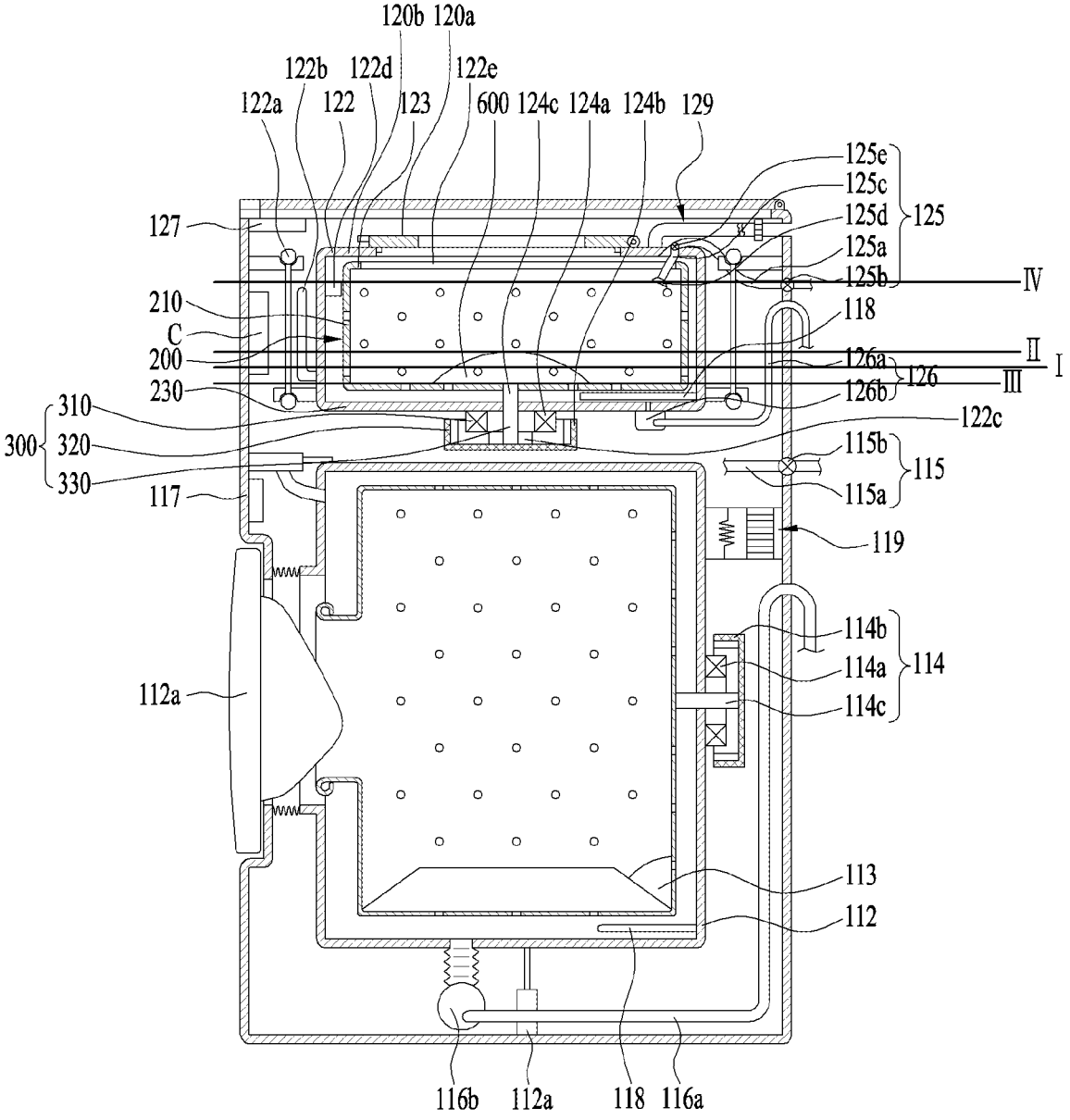
FIG. 2 is a diagram illustrating an example of a sectional view showing the interior of a laundry treatment apparatus according to an implementation.
Figure 3:
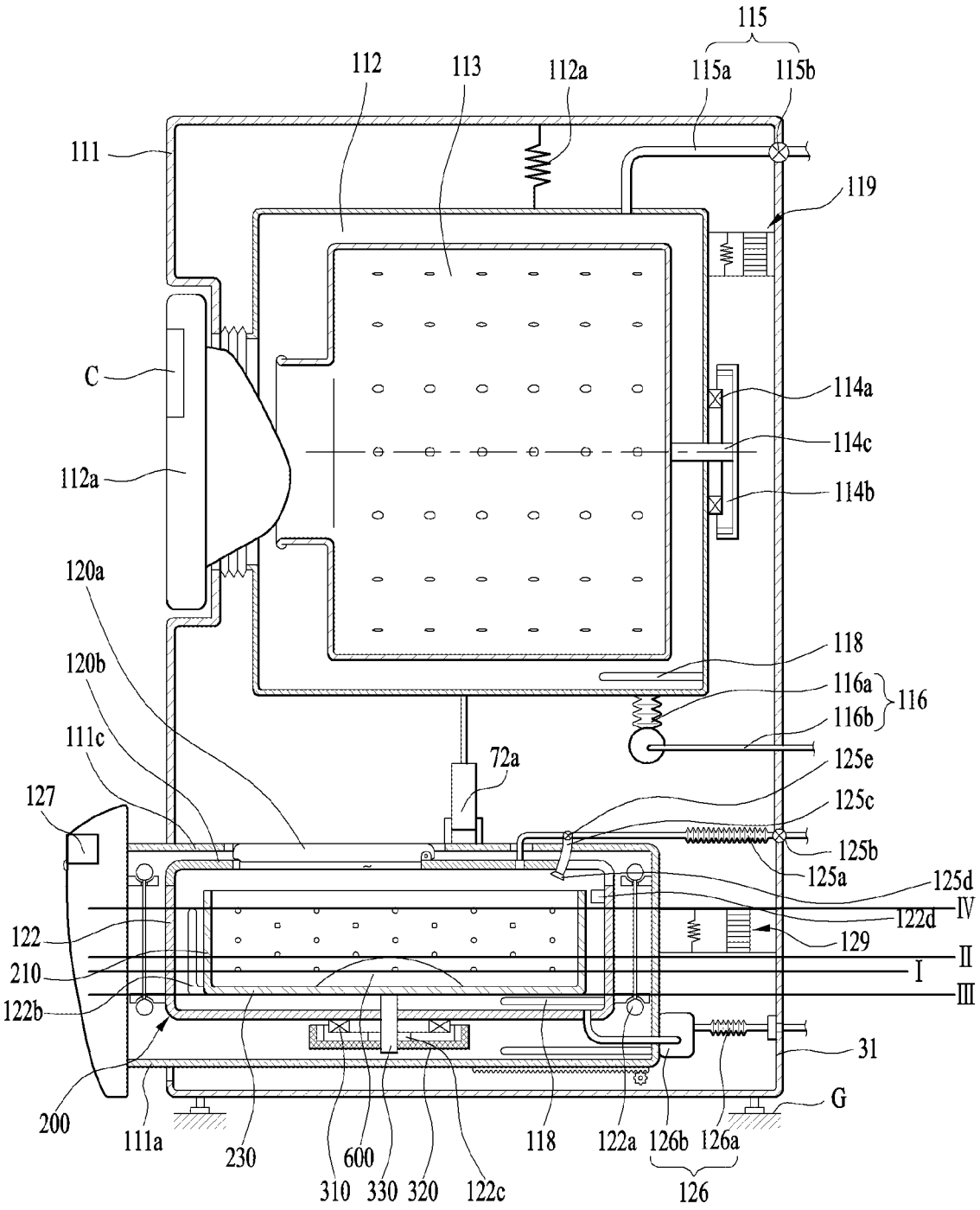
FIG. 3 is a diagram illustrating an example of a sectional view showing the interior of a laundry treatment apparatus according to another implementation.

FIGS. 2 and 3 show the interiors of laundry treatment apparatuses according to some implementations.

FIG. 2 shows the case in which a first washing apparatus 110 is disposed under a second washing apparatus 120, and FIG. 3 shows the case in which a first washing apparatus 110 is disposed on a second washing apparatus 120.

FIGS. 2 and 3 show the case in which the first washing apparatus 110 and the second washing apparatus 120 may be provided in a single cabinet 111. Alternatively, the first washing apparatus 110 and the second washing apparatus 120 may be separately provided such that the first washing apparatus 110 and the second washing apparatus 120 include different cabinets.

In addition, FIGS. 2 and 3 show the case in which the first washing apparatus 110 is configured as a front loading type laundry treatment apparatus and the second washing apparatus 120 is configured as a top loading type laundry treatment apparatus. Alternatively, the first washing apparatus 110 and the second washing apparatus 120 may be configured as other different types of laundry treatment apparatuses.

The first washing apparatus 110 may include first laundry receiving units 112 and 113 provided in the first cabinet 111 for receiving laundry, and the second washing apparatus 120 may include a second laundry receiving unit 200 provided in the second cabinet 121 for receiving laundry.

In the case in which the first washing apparatus 110 is configured as a washer, the first laundry receiving units 112 and 113 may include a first tub 112 for storing water and a first drum 113 rotatably provided in the first tub 112 for receiving laundry. The first washing apparatus 110 may further include a first driving unit 114 provided at one surface of the first tub 112 for rotating the first drum 113, a first water supply unit 115 for supplying water to the first tub 112, and a first drainage unit 116 for draining water from the first tub 112. The first driving unit 114 may include a first stator 114*a* for generating a rotating magnetic field, a first rotor 114*b* configured to be rotatable by the rotating magnetic field, and a first shaft 114*c* for connecting the first rotor 114*b* to one surface of the first drum 113. Alternatively, the first driving unit 114 may include a motor provided at one side of the first tub 112, a shaft connected to one surface of the first drum 113, the shaft protruding to the rear surface of the first tub 112, pulleys provided at the shaft and the motor, and a belt interconnecting the pulleys.

The first water supply unit 115 may include a first water supply pipe 115*a* connecting the first tub 112 to an external water supply source and a first water supply valve 115*b* for adjusting the flow rate of water in the first water supply pipe 115*a*.

The first drainage unit 116 may include a first drainage pipe 116*a* extending from the first tub 112 to the outside of the first cabinet 111 and a first drainage pump 116*b* for providing the power necessary to drain water from the first tub 112, the first drainage pump 116*b* communicating with the first drainage pipe 116*a*.

In the case in which the second washing apparatus 120 is configured as a washer, the second washing apparatus 120 may have the same functions as the first washing apparatus 110 except that the second washing apparatus 120 is different in size from the first washing apparatus 110.

That is, the second washing apparatus 120 may include a second tub 122 provided on, under, or beside the first washing apparatus 110 for storing water, a second drum 200 rotatably provided in the second tub 122 for receiving laundry, a second driving unit 300 provided at one surface of the second tub 122 for rotating the second drum 200, a second water supply unit 125 for supplying water to the second tub 122, and a second drainage unit 126 for draining water from the second tub 122.

The second drum 200 may be formed in a cylindrical shape. The second drum 200 may be provided in the upper part thereof with an opening 123. The opening 123 of the second drum 200 communicates with an introduction port 122*e* formed in the upper part of the second tub 122.

A tub door 120*a* is provided to open and close the introduction port 122*e* of the second tub 122. When the tub door 120*a* covers the introduction port 122*e*, the second tub 122 is substantially sealed.

A tub cover 120*b* is provided at the upper part of the second tub 122. The tub cover 120*b* covers the upper part of the second tub 122. The lateral space between the second tub 122 and the second drum 200 is covered by the tub cover 120*b*.

The introduction port 122*e* in the second tub 122 is defined by the tub cover 120*b*. Consequently, the tub cover 120*b* may be mounted to the second tub 122.

Since the possibility of the second washing apparatus 120 being used as an auxiliary laundry treatment apparatus is good, the second washing apparatus 120 may have a smaller volume than the first washing apparatus 110. However, it is necessary to provide a predetermined level of washing efficiency and washing capacity of the second washing apparatus 120.

To this end, the second drum 200 may be configured such that the diameter of a drum introduction port, through which laundry is introduced, or the bottom surface 230 of the second drum is greater than the width of surfaces of the second drum adjacent to the drum introduction port. In other words, the second drum 200 may be configured such that the length of the surface perpendicular to a second shaft 330 is greater than that of the surface parallel to the shaft.

For example, in the case in which the drum introduction port faces upward, the second drum may be configured such that the width of the second drum is greater than the height of the second drum.

As a result, the diameter of the surface that is rotated by the shaft is increased, thereby further increasing the centrifugal force of the second drum 200 and greatly improving the efficiency of washing of laundry in the second drum 200. In addition, the area of the second drum 200 in which laundry is received and supported is increased, thereby increasing the washing capacity of the second drum 200.

In some implementations, the first washing apparatus 110 includes a first support part 112*a* for supporting the first tub 112 at the cabinet 111, and the second washing apparatus 120 includes a second support part 122*a* for supporting the second tub 122 at the cabinet 111.

The first support part 112*a* and the second support part 122*a* may be configured as a combination of a spring and a damper or as a combination of a bracket and a connection bar.

The shapes of the first support part 112*a* and the second support part 122*a* are not particularly restricted, as long as the first support part 112*a* and the second support part 122*a* are capable of supporting the first tub 112 and the second tub 122.

In some implementations, the cabinet 111 may further include a partition wall 111*b* for partitioning the first washing apparatus 110 and the second washing apparatus 120 from each other.

In the case in which the second washing apparatus 120 is configured as a drawer type washing apparatus, a drawer 111*a* may be provided in the cabinet 111 such that the drawer 111*a* can be withdrawn from the cabinet 111, and the second tub 122 and the second drum 200 may be provided in the drawer 111*a*.

The second driving unit 300 may include a second stator 310 for generating a rotating magnetic field, a second rotor 320 configured to be rotatable by the rotating magnetic field, and a second shaft 330 for connecting the second stator to one surface of the drum.

Alternatively, the second driving unit 300 may include a motor provided at one side of the second tub 122, a shaft connected to one surface of the drum, the shaft protruding to the rear surface of the tub, pulleys provided at the shaft and the motor, and a belt interconnecting the pulleys.

The second water supply unit 125 may include a second water supply pipe 125*a* connecting the second tub 122 to an external water supply source and a second water supply valve 125*b* for adjusting the flow rate of water in the second water supply pipe 125*a*.

In some implementations, the second water supply unit 125 may further include a divergence pipe 125*c* diverging from the second water supply pipe 125*a* and a spray nozzle 125*d* provided in the end of the divergence pipe 125*c* so as to face the interior of the second tub.

A divergence valve 125*e*, such as a three-way valve, may be provided in the connection part of the divergence pipe 125*c* and the second water supply pipe 125*a*.

The spray nozzle 125*d* may be provided in the end of the second water supply pipe 125*a*.

The spray nozzle 125*d* may supply water to the second tub 122*a* in the form of spray.

As a result, laundry received in the second drum 200 may be effectively wetted.

In addition, the second drainage unit 126 may include a second drainage pipe 126*a* extending from the second tub 122 to the outside of the first cabinet 121 and a second drainage pump 126*b* for providing power necessary to drain water from the second tub 122, the second drainage pump 126*b* communicating with the second drainage pipe 126*a*.

The first washing apparatus 110 may include a first heater 118 for heating water in the first tub 112 and a first hot air supply unit 119 for supplying hot air to the first tub 110.

The first heater 118 may be provided at the lower part of the first tub 110. A sheath heater may be used as the first heater 118.

The shape of the first heater 118 is not particularly restricted as long as the first heater 118 is capable of heating water in the first tub 110.

The first hot air supply unit 119 may include a duct 119*a* for supplying air to the first tub 110, a duct heater 119*b* provided in the duct 119*a*, and a fan 119*c* for supplying air from the duct 119*a* to the first tub 112.

In the same manner as the first washing apparatus 110, the second washing apparatus 120 may include a second heater 128 and a second hot air supply unit 129.

In some implementations, the first washing apparatus 110 and the second washing apparatus 120 may include a power supply unit for supplying power to the first washing apparatus 110 and the second washing apparatus 120.

The power supply unit may be configured as a switch provided at the cabinet 111. The power supply unit may be provided at one side of the control panel C.

The power supply unit may include a first power supply unit 117 for supplying power to the first washing apparatus 110 and a second power supply unit 117 for supplying power to the second washing apparatus 120.

In some implementations, at least one selected from between the first washing apparatus 110 and the second washing apparatus 120 may be configured as a dryer. In the case in which at least one selected from between the first washing apparatus 110 and the second washing apparatus 120 is configured as a dryer, the processing unit may not include a water supply unit, a drainage unit, a tub, and a heater.

In addition, the second washing apparatus 120 may include at least one selected from among a water level sensor 122*b* for sensing the level of water in the second tub 122, a temperature sensor 122*d* for sensing the temperature of the second tub 122, and a load sensor 122*c* for sensing the load of the second drum 200.

The construction of the water level sensor 122*b* is not particularly restricted as long as the water level sensor 122*b* is capable of sensing the level of water in the second tub 122. The construction of the temperature sensor 122*d* is not particularly restricted as long as the temperature sensor 122*d* is capable of sensing the temperature of the second tub 122. The construction of the load sensor 122*c* is not particularly restricted as long as the load sensor 122*c* is capable of sensing the load of the second drum 200.

The second washing apparatus 120 may further include an agitation unit 600 provided at the bottom surface of the second drum 200 for agitating laundry. For example, the agitation unit 600 may agitate laundry as the laundry rotates around the agitation unit 600. As such, in some scenarios, the agitation unit 600 may improve the efficiency of washing of laundry if the second drum 200 is of relatively small size.

The agitation unit 600 may be coupled to the bottom surface of the second drum 200 or may be integrally formed with the second drum 200. In some implementations, the agitation unit 600 may be rotatable together with the second drum 200.

In some implementations, the agitation unit 600 may be rotatably provided at the bottom surface of the second drum 200 so as to be rotatable in the same direction as the second drum 200, to be rotatable in the direction opposite the direction in which the second drum 200 is rotated, or to be rotatable irrespective of the direction in which the second drum 200 is rotated.

Figure 4:
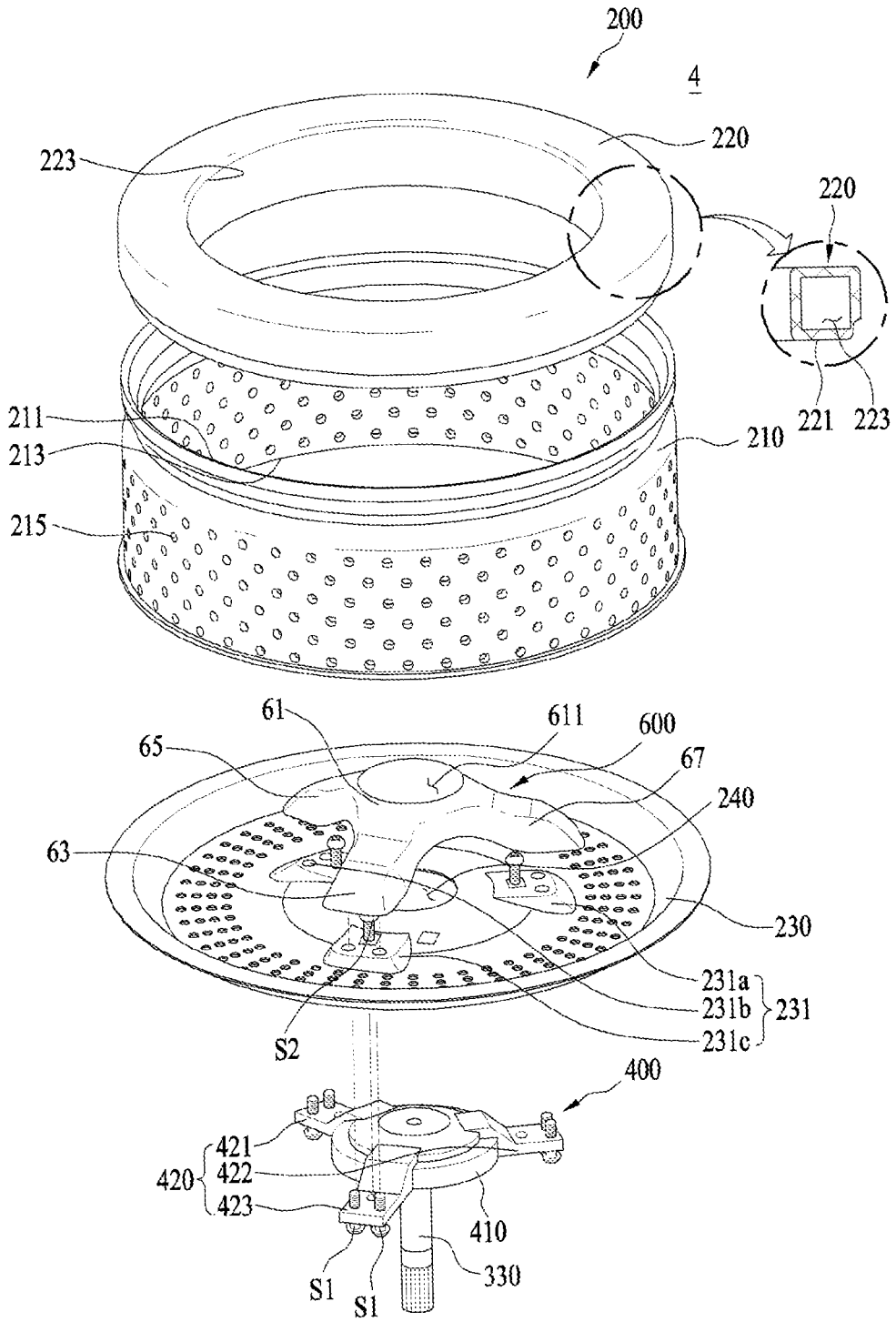
FIG. 4 is a diagram illustrating an example of a construction of a drum, an agitation unit, and a driving unit.

FIG. 4 is a view showing an implementation in which the agitation unit 600 is coupled to the second drum.

The second drum 200 includes a cylindrical drum body 210 having an open lower surface 213, a drum bottom surface 230 fixed to the drum body 210 for closing the open lower surface 213, and a drum introduction port located at the upper surface of the drum body 210 for allowing laundry to be introduced therethrough.

As previously described, the width of the drum body 210 is less than the diameter of the drum bottom surface 230.

The drum introduction port may be configured as an open surface 211 formed at the upper part of the drum body. In the case in which a balancer 220 is provided at the open upper surface 211, however, the drum introduction port may be configured as a through hole 223 provided in the balancer 220.

That is, in the case in which the balancer 220 includes a housing 221 fixed to the open upper surface 211, a through hole (i.e. a housing through hole) 223 formed through the housing, and a channel 225 defined in the housing for allowing a fluid or a ball to circulate therealong, the through hole 223 may serve as the drum introduction port.

Only one selected from between the fluid or the ball may be provided in the channel 225. Alternatively, both the fluid and the ball may be provided in the channel 225. When the second drum 200 is eccentrically rotated, the fluid or the ball in the channel 225 of the balancer 220 moves in the direction opposite the direction in which the eccentric force (i.e. the centrifugal force applied to the laundry in the drum) is applied, thereby reducing the eccentric rotation of the drum (i.e. the vibration of the drum).

In some implementations, the drum body 210 is provided with a plurality of communication holes 215, through which the inside and the outside of the drum body communicate with each other. Consequently, the water stored in the second tub 122 may move into the drum body 210 through the communication holes 215, and the water in the drum body 210 may move to the second tub 122 through the communication holes 215.

In some implementations, the second driving unit 300 may further include a shaft fixing unit 400 coupled to the drum bottom surface 230 for enabling easy coupling between the second shaft 330 and the drum bottom surface 230.

The shaft fixing unit 400 may include a fixing body 410 located outside a space defined by the second drum 200 (i.e. a laundry receiving space) and a fixing arm 420 extending from the fixing body 410 toward the edge of the drum bottom surface 230.

At least one selected from between the fixing body 410 and the fixing arm 420 may be fixed to the drum bottom surface 230.

The second shaft 330 is fixed to the fixing body 410. The fixing arm 420 may include a first fixing arm 421, a second fixing arm 422, and a third fixing arm 423, which are arranged about the second shaft 330 so as to be spaced apart from each other by a predetermined angle. The first fixing arm 421, the second fixing arm 422, and the third fixing arm 423 may be spaced apart from each other by the same angle or by different angles.

In the case in which the first fixing arm 421, the second fixing arm 422, and the third fixing arm 423 are spaced apart from each other by the same angle, the first fixing arm 421, the second fixing arm 422, and the third fixing arm 423 may be spaced apart from each other by an angle of 120 degrees.

The fixing arm 420 may be coupled to a base 231 provided at the drum bottom surface 230. The second washing apparatus 120 washes laundry using the rotational force of the second drum 200. Frictional mechanically force is generated in the second drum 200 by increasing and decreasing the rotational speed of the second drum 200 or changing the rotational direction of the second drum 200, whereby the laundry received in the second drum 200 is scrubbed.

When the laundry is washed using only the rotation of the second drum 200, however, sufficient frictional mechanically force may not be generated. That is, an additional construction may be required in order to maximize the frictional mechanically force.

To this end, the second washing apparatus 120 may include an agitation unit 600 for applying mechanical force to the laundry received in the second drum 200 to improve washing efficiency.

The agitation unit 600 may include a plurality of arms 63, 65, and 67 protruding from the drum bottom surface 230 and extending from the center of the drum bottom surface 230 toward the circumference of the drum body 210. That is, the arms 63, 65, and 67 may radially extend from the center of the drum bottom surface 230.

The drum bottom surface 230 may fix the agitation unit 600 through the base 231.

FIG. 4 shows the case in which the arms 63, 65, and 67 of the agitation unit 600 are coupled to the base 231. Alternatively, the base 231 may be coupled to the entire lower surface of the agitation unit 600.

A center part 61 provided at the center of the agitation unit 600 may protrude from the drum bottom surface 230 toward the drum introduction port 223, and the arms 63, 65, and 67 may include a first arm 63, a second arm 65, and a third arm 67 arranged about the center part 61 so as to be spaced apart from each other by an angle of 120 degrees. Alternatively, a larger number of arms or a smaller number of arms may be provided. In an implementation, the number of arms is three, to which, however, the present disclosure is not limited.

As previously described, the base 231, which is coupled to the agitation unit 600 or supports the agitation unit 600, may be provided at the drum bottom surface 230. Specifically, the base 231 provided at the drum bottom surface 230 may support the arms 63, 65, and 67 or may be coupled to the arms 63, 65, and 67. The base 231 may include a first arm base 231*a* for supporting the first arm 63, a second arm base 231*b* for supporting the second arm 65, and a third arm base 231*c* for supporting the third arm 67.

In some implementations, the agitation unit 600 may protrude into the second drum 200 such that the agitation unit 600 is rotated simultaneously when the second drum 200 is rotated to apply impact to the laundry, to push the laundry to the drum body 210, or to generate a strong stream of water in the water stored in the second tub 122, thereby maximizing the physical force applied to the laundry.

Figure 5A:
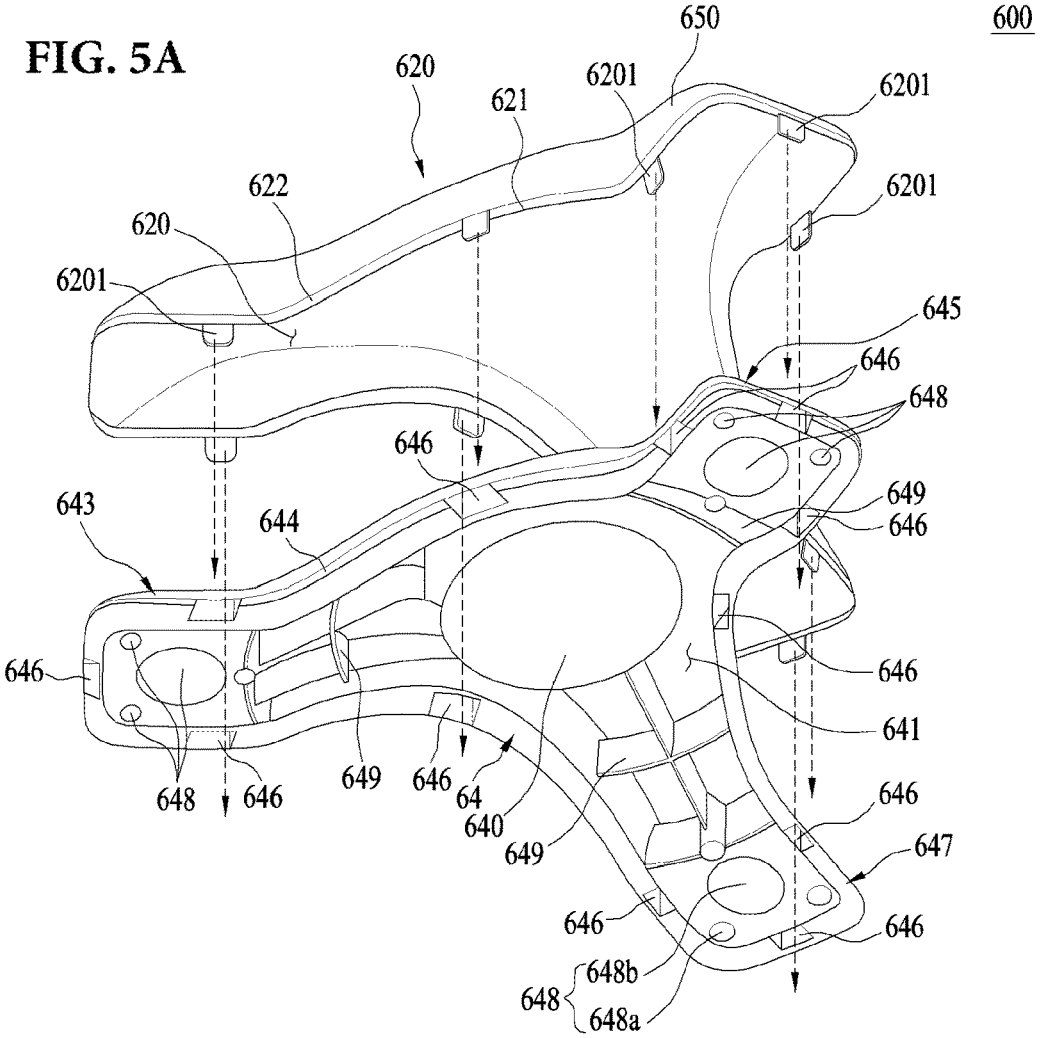
FIGS. 5A and 5B are diagrams illustrating examples of an agitation unit.
Figure 5B:
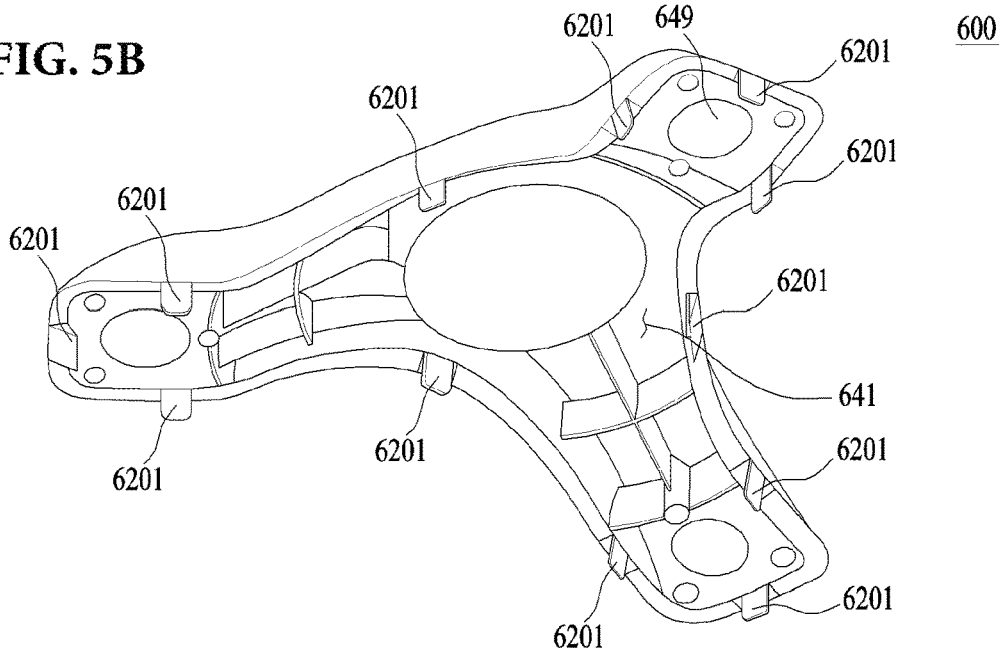

FIGS. 5A and 5B show examples of the structure of the agitation unit 600.

The agitation unit 600 may include an agitation unit body 620 fixed to the drum bottom surface 230 in a protruding fashion for agitating laundry and a reinforcement coupling part 640 received in the agitation unit body 620 for increasing the rigidity of the agitation unit body 620, the reinforcement coupling part 640 being coupled to the drum bottom surface 230 (hereinafter, referred to as the bottom surface) for fixing the agitation unit body 620 to the bottom surface 230.

In some implementations, the portion of the agitation unit 600 that contacts laundry and wash water and the portion of the agitation unit 600 that contacts the drum bottom surface 230 may be separately provided.

The reinforcement coupling part 640 may be a medium for coupling the agitation unit body 620 to the drum bottom surface 230.

The agitation unit body 620 may be made of the same material as the second drum 200, and the reinforcement coupling part 640 may be made of a different material than the second drum 200.

For example, the agitation unit body 620 may be made of stainless steel, and the reinforcement coupling part 640 may be made of a material that is lightweight and can be easily processed or formed, such as plastic or aluminum.

The agitation unit body 620 may be configured as a housing for receiving the reinforcement coupling part 640. The housing 620 may be provided with an opening 622, through which the reinforcement coupling part 640 is inserted. For example, the agitation unit body 620 may be a housing having an opening 622 for receiving the reinforcement coupling part 640. The housing 620 may be configured to have a shape corresponding to that of the reinforcement coupling part 640.

The reinforcement coupling part 640 may include a center part received in the agitation unit body 620 and fixed to the center of the bottom surface 230 and a plurality of arms 643, 645, and 647 radially extending from the center part. In some implementations, the reinforcement coupling part 640 may constitute the frame of the agitation unit 600, and the reinforcement coupling part 640 may serve as the surface of the agitation unit 600.

The agitation unit body 620 may include a center part 621, in which the center part of the reinforcement coupling part 640 is received, and arms 623, 625, and 627, in which the arms 643, 645, and 647 of the reinforcement coupling part 640 are received.

That is, the center part 621 and the arms 623, 625, and 627 of the agitation unit body 620 may be configured as a single housing.

In this case, the agitation unit body 620 and the reinforcement coupling part 640 may be coupled to each other such that the center part 621 of the agitation unit body 620 and the center part of the reinforcement coupling part 640 constitute the center part 61 of the agitation unit 600 and such that the arms of the agitation unit body 620 and the arms of the reinforcement coupling part 640 constitute the first, second, and third arms 63, 65, and 67.

Referring to FIG. 5A, the agitation unit body 620 may be provided with one or more coupling protrusions 6201 for achieving secure coupling with the reinforcement coupling part 640. The coupling protrusions 6201 may protrude from the opening 622.

The reinforcement coupling part 640 may be completely or partially received in the agitation unit body 620.

Referring to FIG. 5B, when the reinforcement coupling part 640 is completely received in the agitation unit body 620, only the lower surface 641 of the reinforcement coupling part 640 may be exposed outward from the surface of the agitation unit 600, and the remaining portion of the reinforcement coupling part 640 may be received in the agitation unit body 620.

The coupling protrusions 6201 may be coupled into location holes 646 provided in the ends and opposite side surfaces of the arms 643, 645, and 647 of the reinforcement coupling part 640. Alternatively, the coupling protrusions 6201 may be coupled into location holes 646 provided in the portions of the center part of the reinforcement coupling part 640 from which the arms 643, 645, and 647 of the reinforcement coupling part 640 do not extend. In other words, the location holes 646 may be formed in the portions of a location plate 644 that correspond to the coupling protrusions 6201.

That is, the location holes 646 may be formed in the portions of the location plate 644 that correspond to the ends and the opposite side surfaces of the arms 643, 645, and 647 of the reinforcement coupling part 640 and that correspond to the portions of the center part of the reinforcement coupling part 640 between the arms.

The surface of the agitation unit body 620 may be plated with a metal material.

Figure 6:
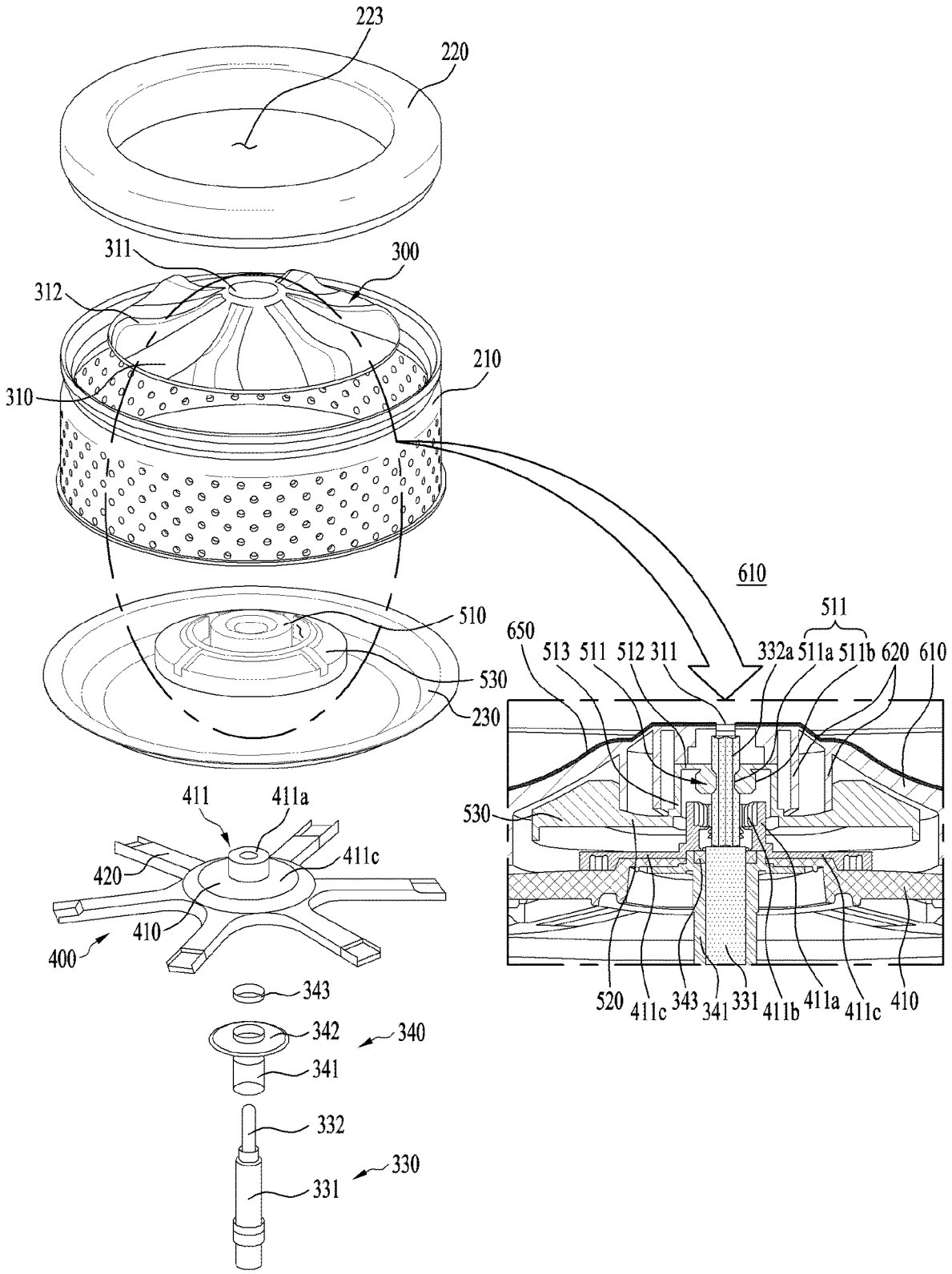
FIG. 6 is a diagram illustrating another example of an agitation unit.

FIGS. 6 and 7 show an implementation in which only the agitation unit 600 is rotatable or both the second drum 200 and the agitation unit 600 are simultaneously rotatable.

The second driving unit 300 may be provided under the agitation unit 600 to provide the power necessary to rotate at least one selected from between the agitation unit 600 and the second drum 200.

The surface 650 of the agitation unit 600 may be plated.

The reason for this is that, when the agitation unit 600 is made of a lighter material than the second drum 200 and the surface of the agitation unit 600 is then plated with a metal material, the moment of inertia is reduced and the agitation unit 600 is consistent with the interior of the second drum 200.

In addition, the second washing apparatus 120 may include a coupling 500 provided between the agitation unit 600 and the second driving unit 300 so as to be rotated by the power from the second driving unit 300. The structure in which the power from the second driving unit 300 is transmitted to the coupling 500 will be described later. The coupling 500 may be provided in the second tub 122 so as to be disposed under the agitation unit 600.

In some implementations where the agitation unit 600 is separately rotatable, the coupling 500 may be configured to rotate the agitation unit 600 and the second drum 200 in different directions or to rotate only the agitation unit 600 when the level of water in the second tub 122 is a predetermined level or higher, and may be configured to rotate the agitation unit 600 and the second drum 200 in the same direction when the level of water in the second tub 122 is lower than the predetermined level. The coupling 500 may be made of a material having a lower specific gravity than water.

For example, the coupling 500 may be made of plastic. In order to increase the rigidity thereof, the coupling 500 may be made of engineered plastic or reinforced plastic. When water is supplied to the second tub 122, therefore, the coupling 500 may move upward toward the agitation unit 600. When water is drained from the second tub 122, therefore, the coupling 500 may move away from the agitation unit 600.

Generally, in a washing process in which mechanical force is applied to laundry to remove foreign matter from the laundry, the level of water in the second tub 122 may be the predetermined level or higher. In a spin-drying process in which the second drum 200 is rotated at a high speed to remove moisture from the laundry, the level of water in the second tub 122 may be lower than the predetermined level. Consequently, the predetermined level may be defined as the level at which the agitation unit 600 is exposed to air.

As such, in some implementations where the agitation unit 600 is separately rotatable, the coupling 500 may be configured to rotate the agitation unit 600 and the second drum 200 in different directions or may rotate only the agitation unit 600 in the washing process and may be configured to rotate the agitation unit 600 and the second drum 200 in the same direction in the spin-drying process.

In order words, the coupling 500 may be configured to rotate the agitation unit 600 and the second drum 200 in different directions depending on the level of water in the second tub 122.

The second washing apparatus 200 may further include a shaft fixing unit 400 for connecting the second driving unit 300 to the bottom surface 230 of the second drum 200.

The shaft fixing unit 400 may be coupled to the outer circumferential surface of the drum body 210. When the shaft fixing unit 400 is rotated, therefore, the drum body 210 may be rotated. When the shaft fixing unit 400 is stopped, the drum body 210 may be stopped.

In other words, the shaft fixing unit 400 may transmit power necessary to rotate the second drum 200.

When the level of water in the second tub 122 is lower than the predetermined level, the coupling 500 may be coupled to the shaft fixing unit 400 to transmit power to the second drum 200. When the level of water in the second tub 122 is the predetermined level or higher, the coupling 500 may be separated from the shaft fixing unit 400 to interrupt the transmission of power to the second drum 200.

Specifically, when the level of water in the second tub 122 is the predetermined level or higher, the coupling 500 may be separated from the shaft fixing unit 400 and may then move upward toward the agitation unit 600. When the level of water in the second tub 122 is lower than the predetermined level, the coupling 500 may move downward and may then be coupled to the shaft fixing unit 400.

The coupling 500 may directly receive power from the second driving unit 300. When the level of water in the second tub 122 is the predetermined level or higher, therefore, the coupling 500 may be coupled to the agitation unit 600 in order to rotate only the agitation unit 600, in implementations where the agitation unit 600 is separately rotatable. When the level of water in the second tub 122 is lower than the predetermined level, the coupling 500 may be coupled to the shaft fixing unit 400 in order to rotate the shaft fixing unit 400.

Hereinafter, the scheme in which the coupling 500 receives power from the second driving unit 300 and the structure in which the coupling 500 selectively rotates the shaft fixing unit 400 will be described.

The second driving unit 300 includes a shaft receiving unit 340 for rotatably receiving the second shaft 330. The second shaft 330 extends through the shaft receiving unit 340. The shaft fixing unit 400 may include a hub 410, to the lower part of which the shaft receiving unit 340 is coupled, the hub 410 including a shaft through part 411, through which the second shaft 330 extends, and fixing arms 420 radially extending from the hub 410 so as to be coupled to the bottom surface 230 of the drum.

That is, the second shaft 330 may be configured to be rotated by the second stator 310 and the second rotor 320 but not to directly rotate the shaft fixing unit 400 due to the shaft receiving unit 340. In other words, the second shaft 330 may be freely rotatable in the shaft receiving unit 340, and may extend through the shaft fixing unit 400.

The agitation unit 600 may be coupled to the end of the second shaft 330 so as to be rotatable together with the second shaft 330. That is, the power generated from the second driving unit 300 may be directly transmitted to the agitation unit 600. However, the power generated from the second driving unit 300 is not directly transmitted to the shaft fixing unit 400.

In some implementations, the coupling 500 may be provided above the hub 410 so as to be movable upward and downward along the second shaft 330 depending on a change in the level of water in the second tub 122.

The coupling 500 may include a power transmission part 510 coupled to the second shaft 330 for receiving power from the second driving unit 300.

The second shaft 330 may include a shaft body 331 connected to the second rotor 320 and a shaft gear part 332 extending from the shaft body 331, the shaft gear 332 being provided on the outer circumferential surface of the portion thereof that protrudes from the hub 410 with a first gear 332*a*. The shaft through part 411 may include a hub gear 411*a* spaced apart from the shaft gear part 332 by a predetermined distance while receiving at least a portion of the shaft gear part 332. The hub gear 411*a* may be provided on the inner circumferential surface thereof with a second gear 411*b*.

That is, the first gear 332*a* may be provided on the portion of the second shaft 330 that is exposed upward from the hub 410.

The power transmission part 510 may include a coupling gear 511, which is provided on the inner circumferential surface thereof with a third gear 511*a* configured to be engaged with the first gear 332*a* and to be movable in the longitudinal direction of the shaft gear part 332 and which is provided on the outer circumferential surface thereof with a fourth gear 511*b* configured to be engaged with the second gear 411*b* when the power transmission part 510 is inserted between the shaft gear part 332 and the hub gear 411*a*.

When water is introduced into the second tub 122, the power transmission part 510 may move upward in the longitudinal direction of the shaft gear part 332. When water is drained from the second tub 122, the power transmission part 510 may move downward in the longitudinal direction of the shaft gear part 332 and may then be inserted between the shaft gear part 332 and the hub gear 411*a*.

That is, since the third gear 511*a* is engaged with the first gear 332*a* of the shaft gear part 332, the power transmission part 510 may directly receive power from the second shaft 330.

When water is supplied into the second tub 122 and the level of water in the second tub 122 reaches a predetermined level in the state in which the power transmission part 510 is inserted between the shaft gear part 332 and the hub gear 411*a*, therefore, the power transmission part 510 is separated from the shaft gear part 332 and the hub gear 411*a* and then moves upward.

As a result, the hub gear 411*a* is not rotated even when the shaft gear part 332 is rotated. The shaft fixing unit 400 and the second drum 200 are not rotated either. At this time, when the power transmission part 510 contacts the lower part of the agitation unit 600, the agitation unit 600 may be rotated by the coupling 500. When the agitation unit 600 is fixed to the upper end of the shaft gear part 332, the agitation unit 600 may be continuously rotated together with the second shaft 330.

Therefore, for implementations in which the agitation unit 600 is separately rotatable, in the washing process, only the agitation unit 600 is rotated in the state in which the second drum 200 is fixed, with the result that a stream of water is generated in the second drum 200, thereby improving washing efficiency.

In addition, when water is drained from the second tub 122 and thus the level of water in the second tub 122 becomes less than the predetermined level, the power transmission part 510 may be inserted between the shaft gear part 332 and the hub gear 411*a*.

At this time, the fourth gear 511*b* of the coupling gear is engaged with the second gear 411*b* of the hub gear. When the power transmission part 510 is rotated by the shaft gear part 332, therefore, the hub gear 411*a* may be rotated.

In this way, the power transmission part 510 may transmit power generated from the second driving unit 300 to the shaft fixing unit 400 via the hub gear 411*a*, whereby the second drum 200 may be rotated.

At this time, the agitation unit 600 may be rotated together with the shaft gear part 332, whereby the agitation unit 600 and the second drum 200 may be simultaneously rotated.

In the spin-drying process, therefore, the agitation unit 600 and the second drum 200 may be simultaneously rotated, whereby twisting of laundry may be alleviated.

In some implementations, the coupling 500 may further include a fixing plate 512 extending from the upper part of the coupling gear 511 such that the coupling gear is fixed to the fixing plate 512 and a receiving rib 513 extending from the end of the fixing plate 512 for separably receiving the hub gear 411*a*.

That is, a space for receiving the hub gear 411*a* may be provided under the receiving rib 513 and the fixing plate 512. Water may be introduced into the space. When water is supplied into the second tub 122, therefore, the coupling 500 may float.

In some implementations, the coupling 500 may further include an extension rib 520 extending from the receiving rib 513 and an agitation coupling part 530 protruding from the end of the extension rib so as to be separably coupled to the lower part of the agitation unit 600.

A space which contacts water or into which water is introduced may be provided under the agitation coupling part 530 and the extension rib 520 such that the coupling 500 can more easily float.

In some implementations, the agitation unit 600 may protrude upward such that the coupling 500 can be separably received in the lower part of the center part 61 thereof. In addition, the agitation unit 600 may further include a coupling rib 620 extending downward from the center part 61 thereof so as to be located in the extension rib 520 in order to receive the power transmission part 510.

Consequently, contact force between the agitation unit 600 and the coupling 500 may be increased. In some implementations, the agitation unit 600 may not be fixed to the second shaft 330 but may be freely rotated by the second shaft 330. In this case, the agitation unit 600 may contact the power transmission part 510, the agitation coupling part 530, and the extension rib 520 of the coupling 500. When the coupling 500 is rotated, therefore, the agitation unit 600 may also be rotated.

In some implementations, the shaft receiving unit 340 may include a receiving pipe 341 for rotatably receiving a portion of the second shaft 330 and a receiving fixing part 342 extending from the upper part of the receiving pipe 341 so as to be coupled to the lower part of the hub 410. Consequently, the second shaft 330 may be rotated independently of the shaft receiving unit 340, whereby power may not be directly transmitted to the shaft fixing unit 400.

In addition, the shaft receiving unit 340 may further include a receiving bearing 343 provided at the inner circumferential surface of the receiving pipe 341 for preventing the transmission of power from the second shaft 330 to the shaft receiving unit 340 and inducing free rotation of the second shaft 330.

In some implementations, the shaft through part 411 may further include a hub coupling part 411*c* provided separately from the hub 410 so as to be separably coupled to the hub 410 and extending from the outer circumferential surface of the hub gear 411*a* so as to be coupled to the hub 410.

The above structure may be advantageous when it is difficult to perform a single forming process from the hub 410 to the shaft through part 411 since the shape of the hub 410 is complicated.

Figure 7B:
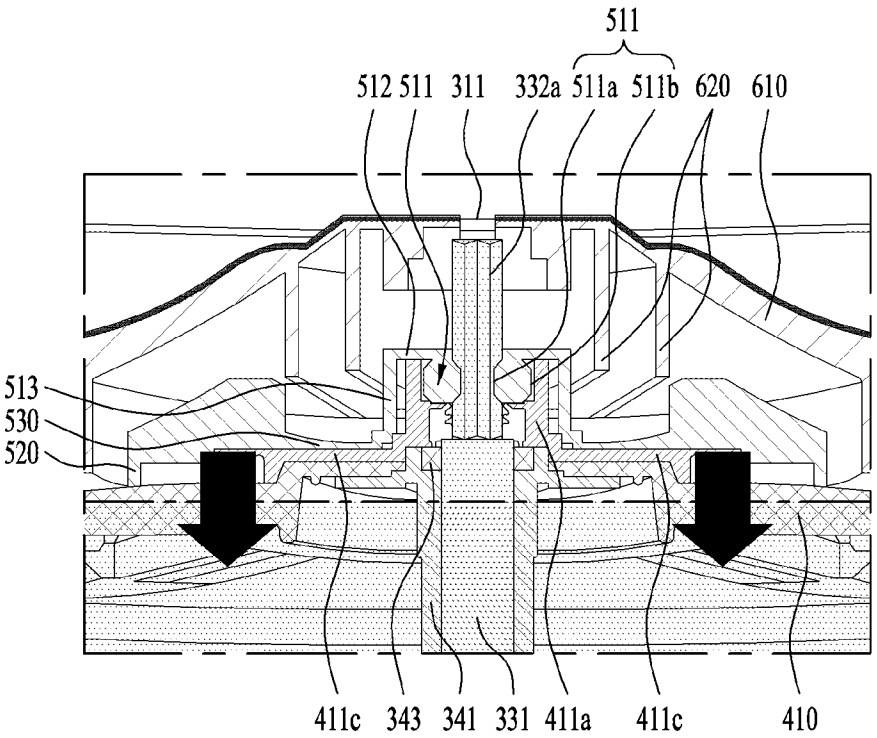
FIGS. 7A and 7B are diagrams illustrating examples of an operation of a coupling.
Figure 7A:
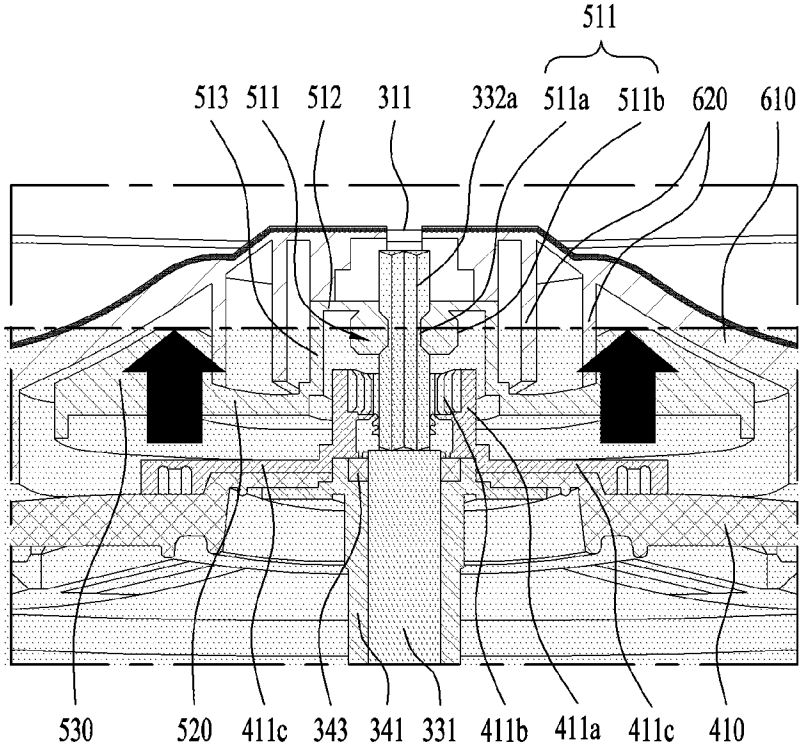

FIGS. 7A and 7B show examples of the change in position of the coupling 500 depending on the level of water in the second tub 122.

Referring to FIG. 7A, when the level of water in the second tub 122 is a predetermined level or higher, water is introduced into the space under the coupling 500, with the result that the coupling 500 moves upward. At this time, the coupling 500 may move upward until the upper part of the coupling 500 comes into contact with the lower part of the center part 61 of the agitation unit 600.

The coupling 500 may rotate the agitation unit 600, since the coupling 500 is rotated by the shaft gear part 332. However, the coupling 500 does not rotate the shaft fixing unit 400, since the coupling 500 is separated from the hub gear 411*a*.

When the level of water in the second tub 122 is the predetermined level or higher, only the agitation unit 600 may be rotated. In the washing process, a stream of water is generated in the second drum 200, and laundry is appropriately twisted, thereby improving washing efficiency.

Referring to FIG. 7B, when the level of water in the second tub 122 is less than the predetermined level, water is discharged from the space under the coupling 500, with the result that the coupling 500 moves downward. At this time, the coupling 500 moves downward until the power transmission part 510 of the coupling 500 is inserted between the hub gear 411*a* and the shaft gear part 332.

When the coupling 500 is rotated by the rotation of the shaft gear part 332, the coupling 500 rotates the hub gear 411*a*.

Additionally, in the case in which the agitation coupling part 530 of the coupling 500 sufficiently protrudes and the coupling rib 620 of the agitation unit 600 contacts the upper surface of the coupling 500, the coupling 500 may rotate the agitation unit 600 while rotating.

Additionally, in the case in which the center part 61 of the agitation unit 600 is fixed to the upper end of the shaft gear part 332, the agitation unit 600 may be rotated when the shaft gear part 332 is rotated.

At this time, the shaft gear part 332, the coupling gear 511, and the hub gear 411*a* may be rotated at the same angular speed.

Consequently, the fixing unit 400 and the agitation unit 600 are simultaneously rotated, thereby achieving the effect of the fixing unit 400 and the agitation unit 600 being rotated as a single body.

In the spin-drying process, twisting of laundry is alleviated, thereby preventing damage to the laundry, since the second drum 200 and the agitation unit 600 are simultaneously rotated, rather than the agitation unit 600 rotating separately from the second drum 200.

Figure 8:
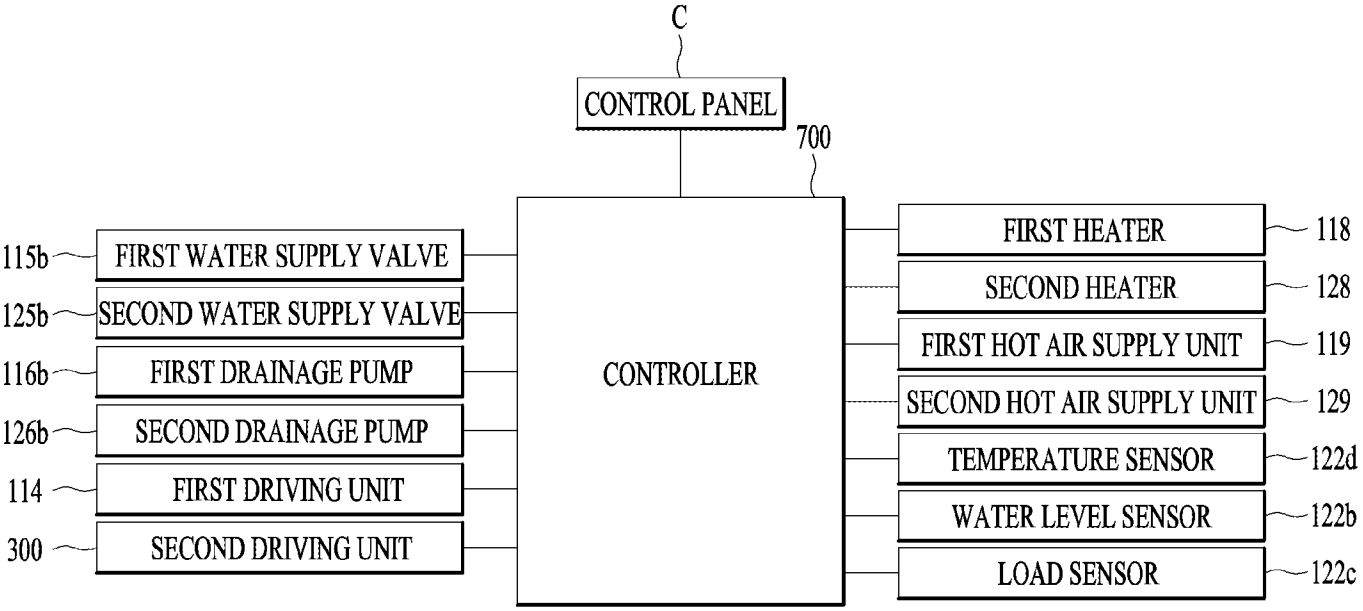
FIG. 8 is a diagram illustrating an example of a control of a laundry treatment apparatus according to some implementations.

Referring to FIG. 8, a controller 700 of the laundry treatment apparatus may control the first washing apparatus 110 and the second washing apparatus 120.

The controller 700 may control all components of the first washing apparatus 110 and the second washing apparatus 120. In addition, the controller 700 may be connected to the control panel C so as to transmit and receive a control signal to and from the control panel C. The controller 700 may be integrated into the control panel C. Alternatively, the controller 700 may be provided separately from the control panel C.

In addition, the controller 700 may control the first water supply valve 115*b*, the second water supply valve 125*b*, the first driving unit 114, the second driving unit 300, the first drainage pump 116*b*, and the second drainage pump 126*b*.

In addition, the controller 700 may control the first heater 118 and the first hot air supply unit 119 of the first washing apparatus 110 and the second heater 128 and the second hot air supply unit 129 of the second washing apparatus 120.

In the case in which the first washing apparatus 110 and the second washing apparatus 120 are separately provided, as previously described, the connection parts 111*a* may be provided to electrically connect the first washing apparatus 110 and the second washing apparatus 120 with each other.

The connection parts 111*a* may serve to transmit a control signal from the controller 700, which is provided in one selected from between the first washing apparatus 110 and the second washing apparatus 120.

In some implementations, the laundry treatment apparatus may perform a course in which the first and second heaters 118 and 128 are driven. That is, the laundry treatment apparatus may perform a course in which the water stored in the first tub 112 or the second tub 122 is heated by the first and second heaters 118 and 128.

The course may be an allergen-removing course for removing ticks and microorganisms from laundry or a boiling course for maximizing laundry washing force.

The allergen-removing course may be a course in which the water in the first tub 112 or the second tub 122 is maintained at a temperature of 50° C. or higher for 10 minutes or more, and the boiling course may be a course in which the water in the first tub 112 or the second tub 122 is heated to a temperature of 50° C. or higher to remove foreign matter from laundry.

In some implementations, in the case in which the boiling course or the allergen-removing course is performed in the second washing apparatus 120, it may not be preferable to heat water to the temperature required in the boiling course or the allergen-removing course after water is supplied into the second tub 122 to a predetermined level in order to perform the boiling course or the allergen-removing course.

The reason for this is that the greater the amount of waters, the greater the amount of energy that is required, since the specific heat of water is high. In order to save energy, therefore, water may be supplied to a predetermined level, the water may be heated to a high temperature, and cold water or hot water may be supplied to a target level such that the cold water or the hot water is mixed with the heated water to attain a target heating temperature.

That is, a small amount of water is heated to a first temperature, and then water is additionally supplied to adjust the total temperature of the water to a second temperature lower than the first temperature. The first temperature may be about 90° C., for example 86.4° C. The second temperature may be about 50° C.

When water contacting laundry is heated to the first temperature, however, the laundry may be damaged.

When water is heated to the first temperature, therefore, it is preferable for the laundry in the second drum 200 to avoid contact with water as much as possible.

In some implementations, when the water in the second tub 122 is heated, it is preferable for the second heater 128 to be immersed in the water. The reason for this is that, if the second heater 128 is operated in the state of being exposed to air, the second heater 128 may be overheated.

In order to satisfy the above conditions, it is preferable to supply water to a level of water at which a portion of the agitation unit 600 is immersed when a course including heating is performed.

The second heater 128 is provided between the bottom surface of the second tub 122 and the bottom surface of the second drum 2300, and the agitation unit 600 is provided above the second heater 128. In the case in which at least a portion of the agitation unit 600 is immersed in water, therefore, the second heater 128 is sufficiently immersed in the water.

In addition, the laundry received in the second drum 200 is located above the agitation unit 600. When a portion of the agitation unit 600 is immersed in water, therefore, the probability of the laundry being exposed to the water heated to the first temperature is very low.

Furthermore, if only the second heater 128 is immersed and the second heater 128 heats only water at a level at which the agitation unit 600 is entirely exposed to air, there is a possibility of the temperature of the second tub 122 not being adjusted to the second temperature when water is additionally supplied to perform the allergen-removing course or the boiling course, since the amount of heated water is too small.

When the allergen-removing course or the boiling course including heating is performed, therefore, the controller 700 may perform control such that the second water supply valve 125*b* is opened until the water level sensor 122*b* senses the level of water in the second tub 122 at which at least a portion of the agitation unit 600 is immersed.

Subsequently, the controller 700 may perform control such that the second water supply valve 125*b* is closed to interrupt the supply of water and the second heater 128 is operated to heat the water in the second tub 122 to the first temperature. Subsequently, when the temperature sensor 122*d* senses that the temperature of the water in the second tub 122 has reached the first temperature, the controller 700 may perform control such that the second water supply valve 125*b* is opened again to supply water to the second tub 122.

As a result, energy may be maximally saved in the course including heating.

Alternatively, the second heater 128 may be immersed, water may be supplied to a level at which the agitation unit 600 is exposed, and the second heater 128 may be operated to heat the water to the first temperature.

In some implementations, when the second heater 128 is operated to heat the water in the second tub 122 to the first temperature, the agitation unit 600 may also be heated to the first temperature due to heat balance.

At this time, the portion of the second drum 200 that is located higher than the agitation unit 600 is not heated to the first temperature, with the result that a temperature difference relative to the agitation unit 600 may be created. The agitation unit 600 may thermally expand as the result of heating, but the portion of the second drum 200 may not thermally expand. As a result, the coupling between the agitation unit 600 and the portion of the second drum 200 may not be effectively achieved.

For example, in the case in which only the agitation unit 600 is heated, the second drum 200 and the agitation unit 600 may rub against each other when the agitation unit 600 or the second drum 200 is rotated, whereby the agitation unit 600 or the second drum 200 may not be smoothly rotated.

Additionally, in the case in which the second water supply pipe 125*a* is opened to abruptly supply water having a temperature lower than the first temperature when the agitation unit 600 has been heated to the first temperature, thermal impact may be applied to the agitation unit 600.

In the case in which the agitation unit 600 is made of a different material than the second drum 200 or includes a component made of a different material than the second drum 200, the agitation unit 600 may be damaged, since the rate of thermal shrinkage of the agitation unit 600 is different from that of the second drum 200.

Additionally, in the case in which the surface of the agitation unit 600 is plated or the agitation unit body 620 and the reinforcement coupling part 640 are made of different materials, the agitation unit 600 may be damaged due to the difference in thermal shrinkage.

For example, the surface of the agitation unit 600 may be cracked, may swell, or may peel off.

Figure 9:
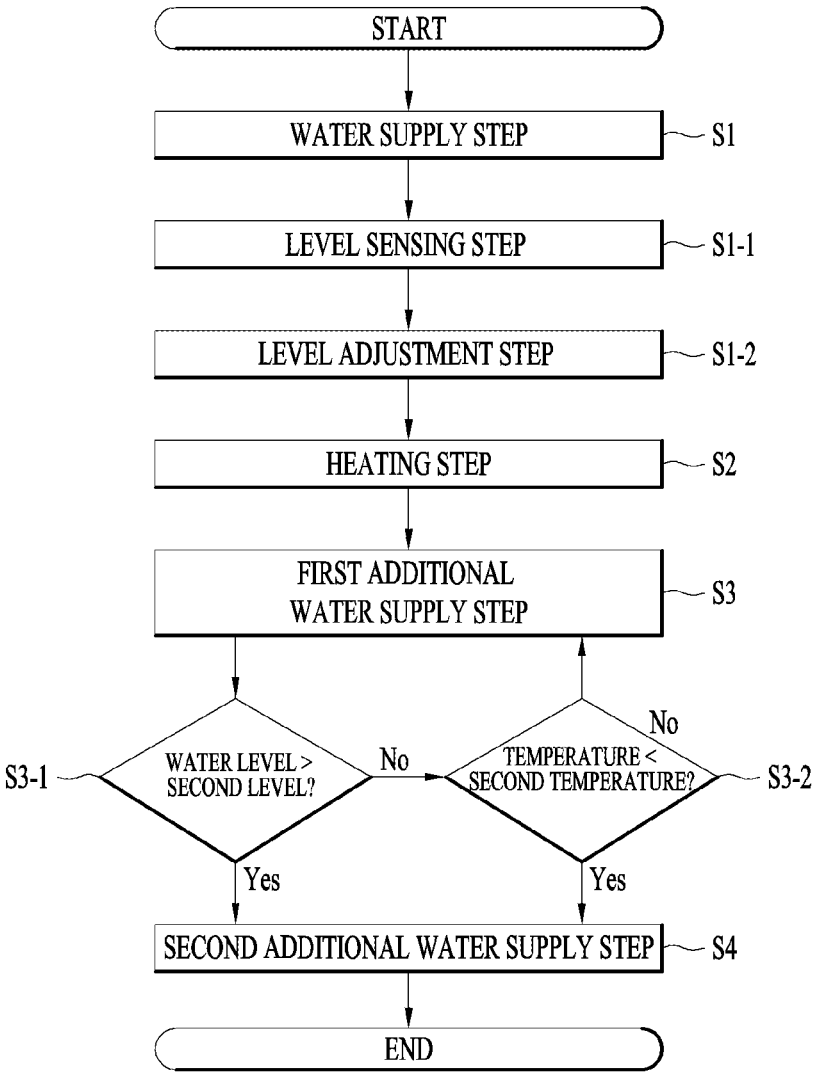
FIG. 9 is a diagram illustrating an example of a control flow of a laundry treatment apparatus according to some implementations.

FIG. 9 shows a control method that is capable of preventing damage to the agitation unit 600.

When the second water supply valve 125*b* is opened to supply water to the second tub 122 under the control of the controller 700, a level at which at least a portion of the agitation unit 600 is immersed in the water in the second tub 122 may be defined as a first level I, a level at which the agitation unit 600 is entirely immersed in the water may be defined as a second level II, and a level at which the second heater 128 is immersed in the water may be defined as a third level III. That is, the level of water is increased in the order of the third level III, the first level I, and the second level II (see FIGS. 2 and 3).

The controller 700 may determine the level of water in the second tub 122 by directly sensing the level of water in the second tub 122 through the water level sensor 122*b* or using data regarding the opening time of the second water supply valve 125*b* and the flow rate per unit time in the second water supply pipe 125*a*.

The laundry treatment apparatus may perform a course including heating to heat water using a heater. The controller 700 may analyze information about a course that a user inputs through the control panel C to perform the course including heating.

When the course including heating is selected or performed, the controller 700 may perform control so as to perform a water supply step (S1) of supplying water into the tub to a first level at which at least a portion of the agitation unit 600 is exposed, a heating step (S2) of operating the heater to heat the water in the tub to a first temperature, and a first additional water supply step (S3) of intermittently supplying water to a second level at which the entirety of the agitation unit 600 starts to be immersed in the water.

The first additional water supply step (S3) may be a step of slowly reducing the change in temperature in the tub. In particular, the first additional water supply step (S3) may be a step of stepwise reducing the change in temperature in the tub.

That is, the controller 700 may perform control such that the second water supply valve 125*b* is opened until water is supplied to the first level such that at least a portion of the agitation unit 600 is immersed in the water, the second heater 128 is operated to heat the water in the second tub 122, and the second water supply valve 125*b* is intermittently opened after the operation of the second heater 128 is completed.

The controller 700 may perform control such that a small amount of water is supplied to the second tub 122, the second heater 128 is operated to heat the water to a high temperature, and the heated water is mixed with water supplied at the first additional water supply step, thereby obtaining a desired temperature.

When the heating step (S2) is completed, the agitation unit 600 may also be heated, and may be heated to the first temperature due to heat balance. At the first additional water supply step (S3), water having a temperature lower than the first temperature is intermittently supplied to solve the above problem.

The controller 700 may perform control such that water is supplied for a first predetermined amount of time at the first additional water supply step (S3), waiting is performed for a second predetermined amount of time, water is supplied again for the first predetermined amount of time, and waiting is performed for the second predetermined amount of time, which are repeated, thereby slowly reducing the temperature of the agitation unit 600.

Since the temperature of the agitation unit 600 is slowly reduced, as described above, the agitation unit 600 may be prevented from being damaged even in the case in which the agitation unit 600 is made of a different material than the second drum 200 or includes a component made of a different material than the second drum 200.

Additionally, in the case in which the agitation unit body 620 and the reinforcement coupling part 640 of the agitation unit 600 are made of different materials, the difference in thermal shrinkage may be considerably reduced, thereby preventing the agitation unit 600 from being damaged.

Additionally, in the case in which the surface of the agitation unit 600 is plated with a material having a different coefficient of thermal expansion than the agitation unit 600, the difference in thermal shrinkage between the surface and the interior of the agitation unit 600 may be considerably reduced, thereby preventing the agitation unit 600 from being damaged.

In some implementations, in the case in which the agitation unit 600 is made of a metal material, the temperature of the agitation unit 600 may be abruptly changed by even a small amount of water. For this reason, it is preferable for the first predetermined amount of time to be very short. In addition, it is necessary to secure a time for which the entirety of the agitation unit 600 reaches a thermal equilibrium state due to the water supplied for the first predetermined amount of time. For this reason, it is preferable for the second predetermined amount of time to be relatively long.

The first predetermined amount of time may be 0.1 seconds, and the second predetermined amount of time may be 10 seconds. That is, when the operation of the second heater 128 is completed, the time for which the second water supply valve 125*b* is open may be shorter than the time for which the second water supply valve 125*b* is closed.

At the first additional water supply step (S3), the controller 700 may perform control such that the second drum 200 is rotated. The reason for this is that, when the second drum 200 is rotated, air flows in the second drum 200 and laundry frequently contacts the agitation unit 600, whereby the agitation unit 600 is more effectively cooled.

That is, the controller 700 may perform control such that the second driving unit 300 is operated when the second water supply valve 125*b* is intermittently opened.

In some implementations, before the heating step (S2) is commenced, the second heater 128 must be immersed in water, and at least a portion of the agitation unit 600 must be exposed.

At the water supply step (S1), however, the level of water in the second tub 122 may be lower than the third level or may be higher than the first level for several reasons.

Consequently, the controller 700 may perform control such that a first level sensing step (S1-1) of sensing whether the water in the second tub 122 is lower than the third level or is higher than the first level is performed at the water supply step (S1).

Upon determining that the level sensed at the first level sensing step (S1-1) is less than the third level, the controller 700 may perform control such that water is supplied into the second tub 122 up to the first level. Upon determining that the level sensed at the first level sensing step (S1-1) is higher than the first level, the controller 700 may perform control so as to perform a level adjustment step (S1-2) of draining the water from the second tub until the level of water in the second tub 122 becomes the first level.

That is, upon sensing that the second heater 128 is exposed to air before the second heater 128 is operated, the controller 700 may perform control such that the second water supply valve 125*b* is opened at the level adjustment step (S1-2). Upon sensing that the entirety of the agitation unit 600 is immersed in water, the controller 700 may perform control such that the second drainage pump 126*b* is operated at the level adjustment step (S1-2).

In some implementations, at the first additional water supply step (S3), washing and drying cycle times may be delayed due to waiting for the second predetermined amount of time. For this reason, it may be inefficient to supply water to a target level for performing the course including heating using an intermittent water supply method of the first additional water supply step.

Consequently, the controller 700 may perform control so as to perform a second level sensing step (S3-1) of sensing whether the level of water sensed by the water level sensor 122*b* at the first additional water supply step (S3) is greater than the second level.

Upon sensing that the level of water in the second tub 122 is greater than the second level at the second level sensing step (S3-1), the controller 700 may perform control so as to perform a second additional water supply step (S4) of supplying water into the second tub 122 to the target level.

That is, upon determining that the entirety of the agitation unit 600 is immersed in water at the first additional water supply step (S3), the controller 700 may perform control so as to immediately perform the second additional water supply step (S4).

At the second additional water supply step (S4), water may be continuously supplied to the target level.

When water is continuously supplied at the second additional water supply step (S4), the controller 700 may perform control such that second water supply valve 125*b* is intermittently opened until the agitation unit 600 is immersed in water, i.e. until the level of water becomes the second level. Subsequently, when the entirety of the agitation unit 600 is immersed in water, the controller 700 may perform control such that second water supply valve 125*b* is continuously open.

Subsequently, upon sensing that the level of water in the second drum 200 or the second tub 122 is sufficient to wash or rinse laundry through the water level sensor 122*b*, the controller 700 may perform control such that the second water supply valve 125*b* is closed.

The course including heating is included in the washing or rinsing cycle. For this reason, there is no reason to supply water into the second tub 122 to a higher level. That is, the second additional water supply step (S4) may be finished.

A level at which laundry can be washed or rinsed may be defined as a fourth level IV (see FIG. 2).

In some implementations, intermittent water supply may be needed at the second additional water supply step (S4).

The reason for this is that, when cold water is instantaneously supplied into the second tub 122 in the state in which the temperature in the second tub 122 is relatively high, the pressure in the second tub 122 is abruptly reduced, whereby the second tub 122 may be damaged or deformed.

In order to solve this problem, therefore, intermittent water supply may be performed at the second additional water supply step (S4). That is, at the second additional water supply step (S4), water may be supplied for a third predetermined amount of time and waiting may be performed for a fourth predetermined amount of time, which may be repeated.

That is, upon sensing that the entirety of the agitation unit 600 is immersed in water at the first additional water supply step (S3), the controller 700 may perform control so as to change the cycle at which or the time for which the second water supply valve 125*b* is intermittently opened.

The third predetermined amount of time may be longer than the first predetermined amount of time, and the fourth predetermined amount of time may be shorter than the second predetermined amount of time. The reason for this is that agitation may be more greatly affected by the additional water supply.

In some implementations, when the entirety of the agitation unit 600 is immersed in water, the temperature of the agitation unit 600 may be equal to that of the water. Even when cold water is supplied afterward, the cold water is mixed with the water first, whereby the agitation unit 600 is little affected by the cold water.

In the case in which the entirety of the agitation unit 600 is immersed in water, therefore, a large amount of water may be rapidly supplied, whereby the water supply time may be maximally reduced.

In some implementations, when the first additional water supply step (S3) is performed after the heating step (S2), the temperature of the agitation unit 600 may be sufficiently low even in the case in which the agitation unit 600 is not immersed in water, whereby the agitation unit 600 is little affected by the additionally supplied water.

In this case, it is inefficient to perform the first additional water supply step (S3) until the level of water becomes the second level.

Consequently, the controller 700 may measure the temperature of the agitation unit 600 through the temperature sensor 122*d*, and upon determining that the temperature of the agitation unit 600 is sufficiently low, may perform control so as to immediately perform the second additional water supply step (S4).

The controller 700 may indirectly measure the temperature of the agitation unit 600 by measuring the temperature in the second tub 122.

That is, upon sensing that the temperature in the second tub 122 is lower than a specific temperature through the temperature sensor 122*d* before the agitation unit 600 is immersed in water, the controller 700 may perform control so as to continuously open the second water supply valve 125*b* or to change the cycle at which or the time for which the second water supply valve 125*b* is intermittently opened.

The specific temperature may be a temperature equivalent to the temperature of the cold water that is supplied or a temperature different from that of the cold water by about 3° C.

In some implementations, the controller 700 may perform control such that water is guided to the spray nozzle 125*d* via the divergence valve 125*e* at the first additional water supply step (S3).

That is, the second water supply valve 125*b* may be intermittently opened such that water is supplied into the second tub 122 through the spray nozzle 125*d*.

At the first additional water supply step (S3), therefore, water may be supplied into the second tub 122 in the form of spray, whereby a small amount of water may uniformly contact the large area of the agitation unit 600.

As a result, the agitation unit 600 may be slowly and uniformly cooled.

In some implementations, the spray nozzle 125*d* may be provided in the end of the second water supply pipe 125*a*.

In this case, the controller 700 may control only the second water supply valve 125*b* in order to slowly and uniformly cool the agitation unit 600.

As a result, an abrupt change in temperature of the agitation unit 600 may be prevented, thereby preventing damage to the agitation unit 600.

In the above description, the first washing apparatus 110 and the second washing apparatus 120 are provided, and the course including heating is performed in the second washing apparatus 120. Alternatively, the same control method and structure as described above may be applied to the first washing apparatus 110.

In addition, the second washing apparatus 120 may be provided separately from the first washing apparatus 110 so as to be used as a stand-alone laundry treatment apparatus.

Hereinafter, an implementation for solving problems caused by the change in temperature and pressure in the second washing apparatus 120, which is a small-sized laundry treatment apparatus, will be described. In the previous implementation, the change in temperature in the tub is focused on. In this implementation, the change in pressure in the tub is focused on. However, the change in both temperature and pressure in the tub may be focused on.

The space in the tub 122 is not completely physically sealed such that air cannot flow between the inside and the outside of the tub 122. The reason for this is that air can flow between the inside and the outside of the tub 122 though an air channel unit, which is intentionally provided.

The space in the tub 122 may be described as being sealed in the case in which the amount of air that can flow through a communication part between the inside and the outside of the tub 122 per unit time is much less than the amount of air that must flow between the inside and the outside of the tub 122 per unit time in order to reduce the difference in pressure between the inside and the outside of the tub 122, which instantaneously and abruptly occurs.

Consequently, the space in the tub 122 may be instantaneously sealed. That is, when a difference in pressure between the inside and the outside of the tub 122 occurs due to abrupt compression or expansion of air in the tub 122 in the state in which the tub door 120*a* is closed, the amount of air per unit time that can flow between the inside and the outside of the tub 122 is much less than the amount of air per unit time that must flow between the inside and the outside of the tub 122 in order to reduce the difference in pressure between the inside and the outside of the tub 122. As a result, negative pressure or positive pressure may be instantaneously and abruptly generated in the tub 122.

Figure 10:
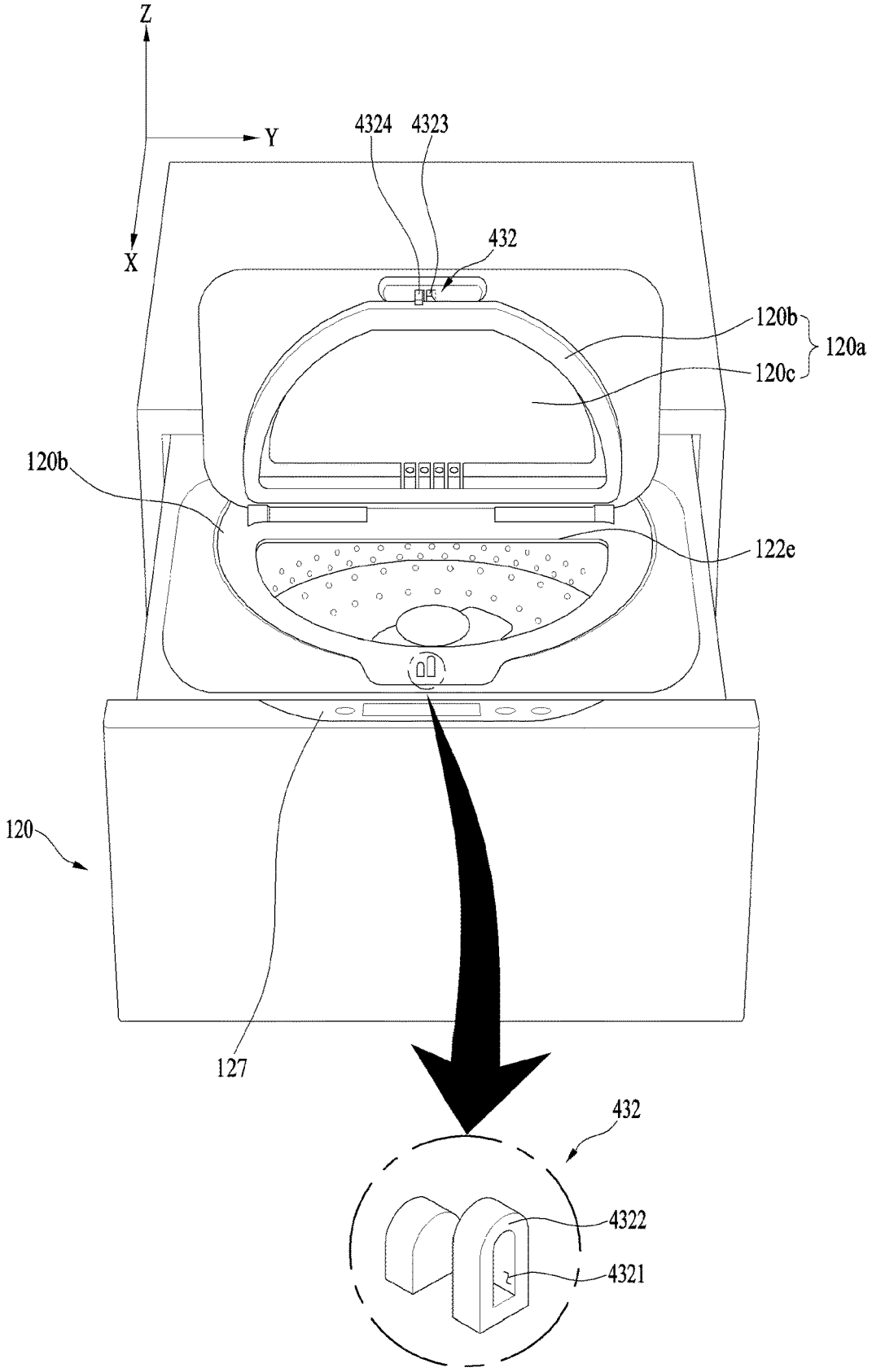
FIG. 10 is a diagram illustrating an example of a structure of a tub door of the laundry treatment apparatus according to some implementations.

The structure of the tub door of the second washing apparatus will be described with reference to FIG. 10. The structure of the tub door, which will be described hereinafter, will be identically or similarly applied to the implementation shown in FIGS. 2 and 3.

The tub door 120*a* may be fixed to the tub cover 120*b* in the form of a hook. A hook hanger may be formed at the tub cover 120*b*. When the hook is inserted into the hook hanger, the tub door 120*a* is closed. When the hook is separated from the hook hanger, the tub door 120*a* is opened.

Specifically, the tub door 120*a* may be locked and unlocked by a push/open button type locking unit 432. That is, when the upper surface of the tub door 120*a* is pushed to close the tub door 120*a*, the tub door 120*a* is locked, and when the upper surface of the tub door 120*a* is pushed again to open the tub door 120*a*, the tub door 120*a* is unlocked.

The locking unit 432 includes a latching protrusion 4322 protruding from the upper surface of the tub cover 120*b*, the latching protrusion 4322 having a fastening hole 4321. The locking unit 432 further includes an unlocking part 4323. The unlocking part 4323 may be provided at the inner surface of the tub door 120*a*.

When a user applies force in the direction in which the latching protrusion 4322 is inserted while closing the tub door, the unlocking part 4323 is inserted into the fastening hole 4321 and is fixed by the latching protrusion 4322. When the user applies force again in the direction in which the latching protrusion 4322 is inserted in the state in which the tub door is closed, the unlocking part 4323 is separated from the fastening hole 4321, whereby the coupling between the latching protrusion 4322 and the unlocking part 4323 is released. Alternatively, the latching protrusion 4322 may be provided at the tub door 120*a*, and the unlocking part 4323 may be provided at the tub cover 120*b*.

In some implementations, the tub door 120*a* or the tub cover 120*b* may be provided with an opening part 4324 for increasing the distance between the tub door 120*a* and the tub cover 120*b*. The opening part 4324 is provided at the inner surface of the tub door 120*a* to provide elastic force toward the tub cover 120*b*. When the tub door is unlocked, therefore, the tub door is pushed from the tub cover.

The laundry treatment apparatus is different from a general top loading type washer as follows. In the general top loading type washer, the upper surface of the tub is open and communicates with the interior of the cabinet. In the laundry treatment apparatus according to the present disclosure, however, the upper surface of the tub is closed.

That is, the introduction port 122*e* formed in the upper part of the tub 122 is opened and closed by the tub door 120*a* rotatably provided at the upper surface of the tub cover 120*b*.

The reason that the upper surface of the tub is closed is that a large amount of bubbles may be generated in the tub 122 due to the rotation of the drum and the generated bubbles may flow outward through the upper surface of the tub, since the height of the tub 122 is smaller than the diameter of the tub 122. In order to solve this problem, the upper surface of the tub is closed.

In some implementations, in order to prevent water in the tub 122 from being discharged outward through the introduction port 122*e*, any one selected from between the tub door 120*a* and the tub cover 120*b* may be further provided with a sealing part 120*b* for sealing the gap between the tub door 120*a* and the introduction port 122*e* when the tub door 120*a* closes the introduction port 122*e*.

In the case in which the tub door 120*a* is provided with a transparent window 120*c*, the user may check whether foreign matter remains through the window 120*c*.

Figure 11:
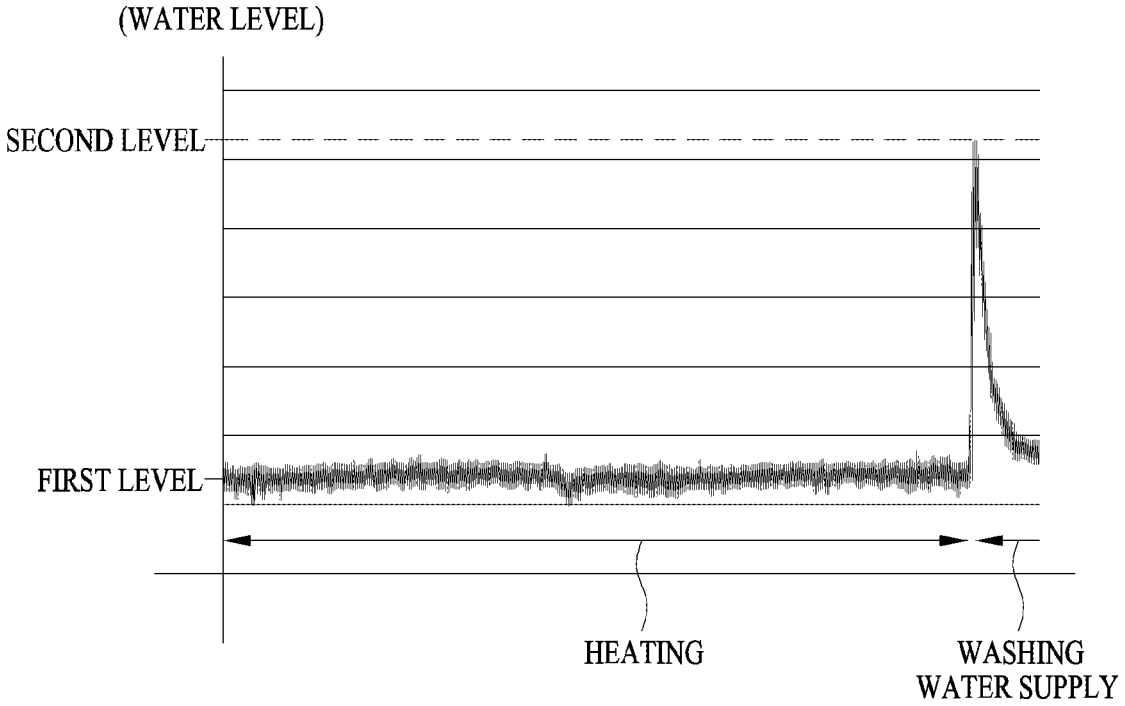
FIG. 11 is a diagram illustrating an example of a change in level of water in a tub when wash water is supplied to perform main washing.

FIG. 11 is a view showing the change in level of water in the tub when wash water is supplied to perform main washing. When water stored to a first level in the tub 122 is heated and then water is supplied into the tub 122 for a subsequent step, the level of water in the tub 122 is abruptly increased from the first level to a second level.

When the tub door 120*a* is closed, the space in the tub 122 is sealed. As previously described, however, the space in the tub 122 is not physically sealed, and a detailed description thereof will be omitted.

When the water stored in the tub 122 is heated and then cold water is additionally supplied, the air in the tub 122 is instantaneously and abruptly condensed, with the result that high negative pressure is instantaneously and abruptly generated in the sealed tub 122, whereby the level of water stored in the tub is increased.

In this case, the tub cover and the tub door may be temporarily or permanently deformed, with the result that an unnecessary gap may be formed between the tub cover and the tub door.

In addition, the negative pressure instantaneously and abruptly generated in the sealed tub 122 may be applied to the tub door, which is configured to be locked and unlocked by the push/open button type locking unit, such that the tub door is moved toward the inside of the tub, whereby the locking unit may be unlocked. In other words, when the negative pressure generated in the tub is higher than the force applied by the user in order to open the tub door, the tub door may be pulled, with the result that the tub door may be opened.

Hereinafter, a method of minimizing the negative pressure that may be instantaneously and abruptly generated in the tub 122 will be described. Such a change in pressure may be caused by the change in temperature.

Figure 12:
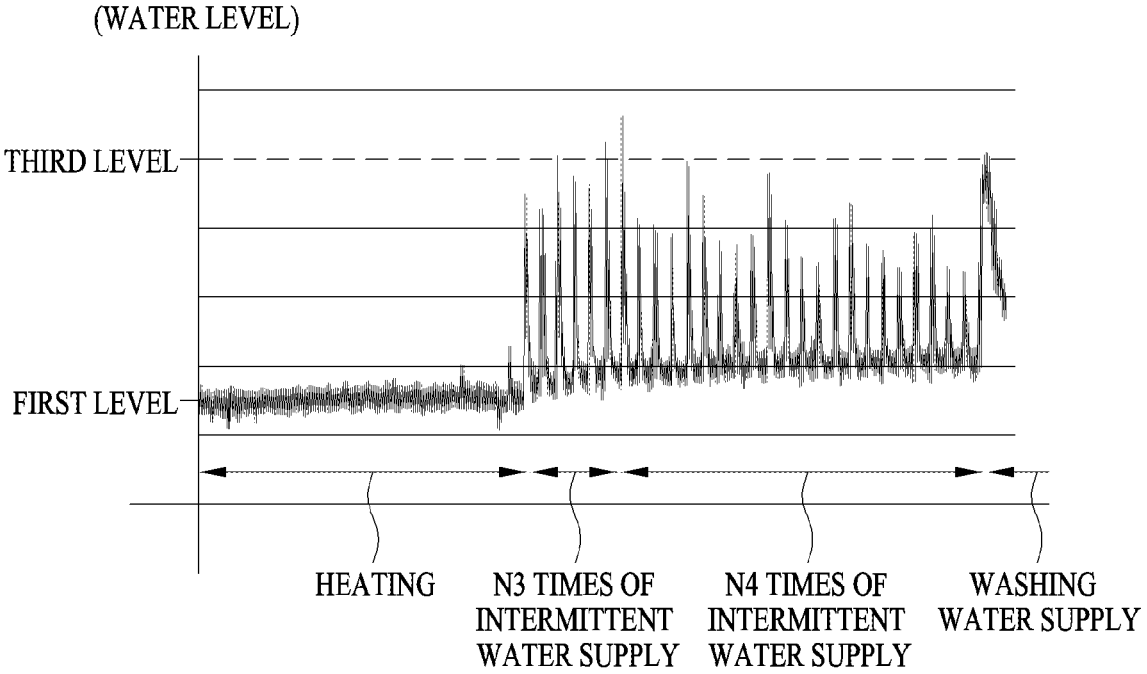
FIG. 12 is a diagram illustrating an example of a change in level of water in the tub when intermittent water supply is performed before wash water is supplied to perform main washing.
Figure 13:
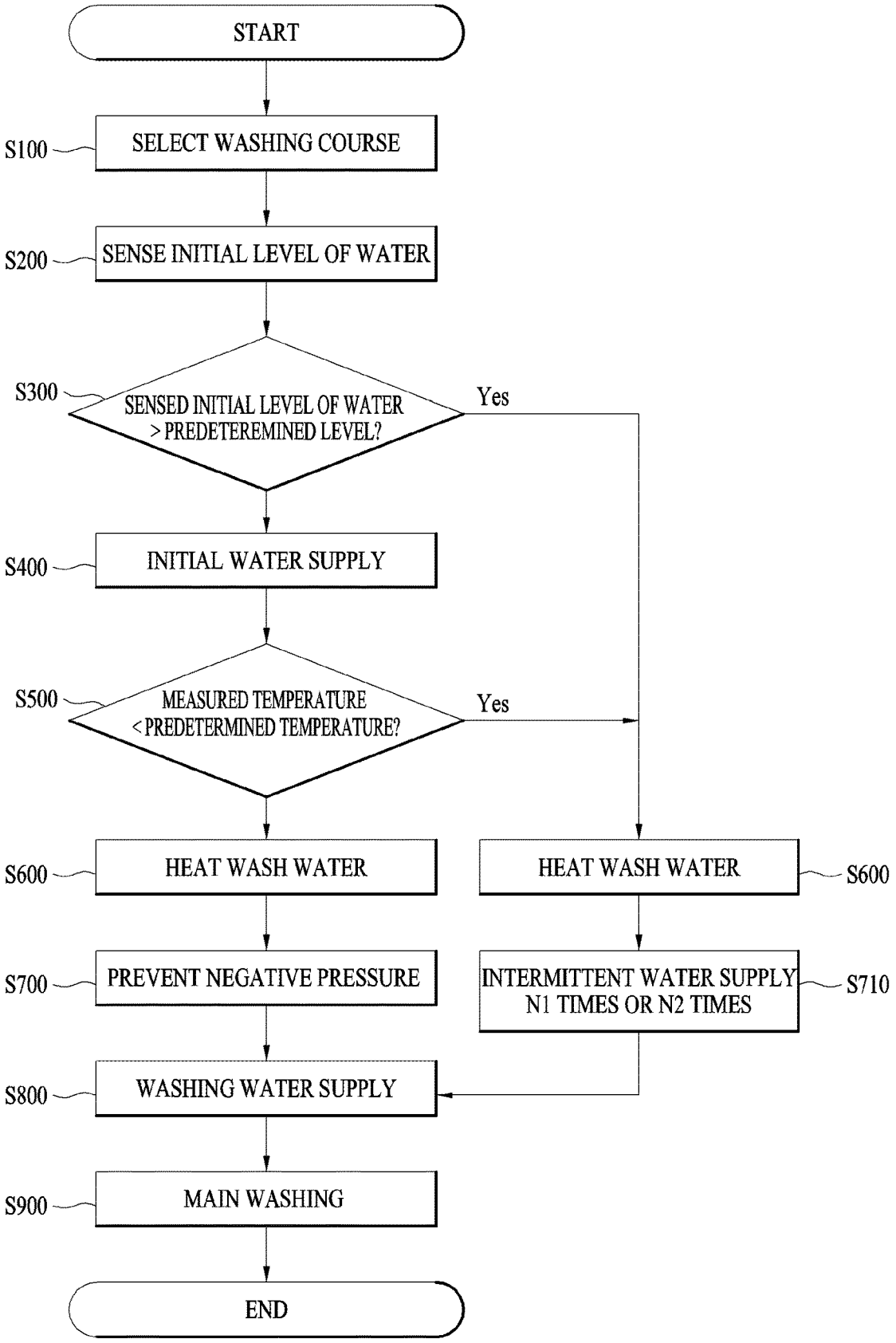
FIG. 13 is a diagram illustrating an example of a control flow of a laundry treatment apparatus according to some implementations.
Figure 14:
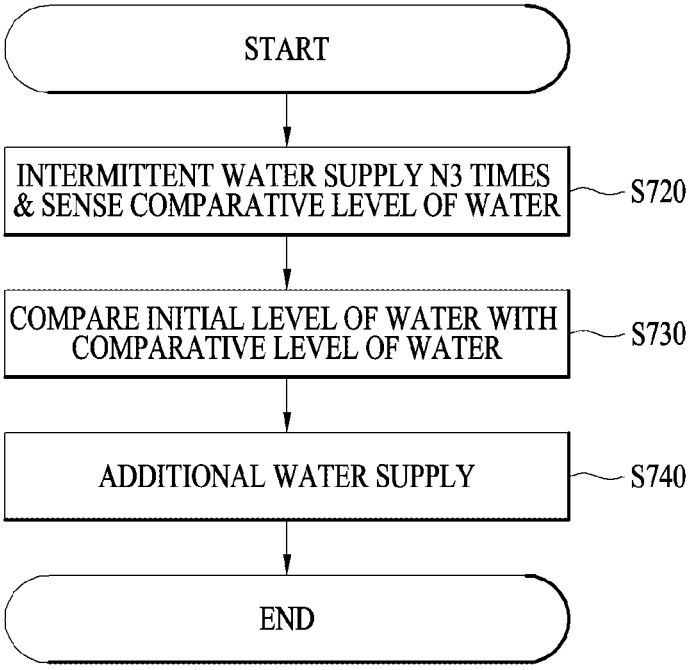
FIG. 14 is a diagram illustrating an example of a control flow for stepwise alleviating environmental changes in a laundry treatment apparatus according to some implementations.

FIG. 12 is a view showing a change in level of water in the tub when intermittent water supply is performed before wash water is supplied to perform main washing. FIG. 13 is a flowchart showing a method of controlling the laundry treatment apparatus according to some implementations, and FIG. 14 is a view showing the detailed flow of a negative pressure prevention or intermittent water supply step shown in FIG. 13.

The method of controlling the laundry treatment apparatus according to some implementations may include a washing course selection step (S100) of selecting a heating course in which laundry is heated, a water supply step (S400) of supplying water to the tub 122, a heating step (S600) of heating the water stored in the tub 122, a negative pressure prevention step (S700) of performing intermittent water supply to supply water into the tub 122 for a first predetermined amount of time and to interrupt the supply of water for a second predetermined amount of time, a washing water supply step (S800) of supplying water to a washing level for washing after the negative pressure prevention step, and a main washing step (S900). The negative pressure prevention step may be a step of stepwise or slowly alleviating abrupt pressure and temperature changes in the tub, i.e. abrupt environmental changes in the tub. Consequently, the negative pressure prevention step may be referred to as an environmental change alleviation step.

When a user selects a washing course at the washing course selection step (S100), the controller 700 performs control such that a washing cycle is performed according to the selected washing course.

The washing cycle is a cycle of supplying water containing detergent into the tub and rotating the drum to wash laundry using frictional force generated on the inner circumferential surface of the drum and bending force caused by a stream of water generated in the tub.

The heating course is a course in which water is supplied into the tub 122 to a predetermined level before the washing cycle of washing the laundry and in which the wash water is heated to a predetermined temperature using the heater 128 provided in the tub 122 to remove microorganisms from the laundry and soak the laundry.

In this case, the wash water may be heated to about 90° C. or higher. The reason for this is that, when water is heated to about 90° C. or higher, germs or microorganisms present in laundry can be effectively killed.

That is, the heating step may be a step of heating water to about 90° C. or higher in addition to simply heating water, i.e. a boiling step. 90° C. may be the highest temperature of wash water that can be allowed or preset in the laundry treatment apparatus.

At the water supply step (S400), the amount of water that is supplied is set depending on the weight of laundry sensed at a laundry weight sensing step performed before the heating course or the water supply step (S400).

The water supply step (S400) may include a temperature sensing step of sensing the temperature of water supplied into the tub 122.

At the temperature sensing step, the temperature of water supplied into the tub 122 may be sensed using the temperature sensor 122*d* provided in the tub 122. The temperature sensor 122*d* may be provided in the water supply pipe to sense the temperature of water that is supplied into the tub 122.

When the temperature of water sensed at the temperature sensing step is lower than a predetermined temperature, intermittent water supply may be repeated N1 times (S500 and S710). In the case in which intermittent water supply is repeated N1 times, water is supplied to a washing level for washing without performing the negative pressure prevention step (S700), and then the main washing step is performed.

When the temperature of water sensed at the temperature sensing step is higher than the predetermined temperature, the negative pressure prevention step (S700) is performed.

The predetermined temperature may be about 10° C., which is the temperature of the water supplied from an external water supply source.

When cold water having a temperature of about 10° C. supplied from the external water supply source is added to the water heated at the heating step (S600), the water in the tub is cooled due to an abrupt change in temperature and the air in the tub is contracted, with the result that negative pressure may be generated in the tub.

In the case in which the temperature of water supplied from the outside is low, therefore, intermittent water supply is performed several times to reduce the temperature of the heated water in the tub 122, thereby preventing negative pressure from being instantaneously generated due to a large amount of water being supplied at once. In this case, N1 times may be 30 times.

In some implementations, the method of controlling the laundry treatment apparatus according to some implementations may include an initial level sensing step (S200) of sensing the initial level of water in the tub before the water supply step (S400).

The initial level sensing step (S200) is performed after the washing course selection step. At the initial level sensing step (S200), whether water is present in the tub 122 is determined before water is supplied into the tub 122.

When the initial level of water sensed at the initial level sensing step (S200) is lower than a predetermined level, the water supply step (S400) may be performed. When the initial level of water sensed at the initial level sensing step (S200) is higher than the predetermined level, intermittent water supply may be repeated N2 times (S500 and S710).

The predetermined level may be a level at which the level of water stored in the tub is sufficient to be heated. Upon determining that the level of water in the tub is higher than the predetermined level, therefore, the heating step (S600), the washing water supply step (S800), and the main washing step (S900) may be performed without performing the water supply step (S400).

Alternatively, upon determining that the level of water in the tub is higher than the predetermined level, a drainage step (not show) of draining water to reduce the level of water in the tub 122 to a level for heating may be performed, followed by the heating step (S600), the washing water supply step (S800), and the main washing step (S900). Consequently, it is possible to make uniform the time for which the heating step is performed through the drainage step of draining water to reduce the level of water in the tub 122 to the level for heating, thereby saving energy. In the case in which intermittent water supply is repeated N2 times, the washing water supply step (S800) and the main washing step (S900) are performed without performing the negative pressure prevention step (S700).

That the sensed initial level of water is higher than the predetermined level means that water has already been stored in the tub 122.

When the temperature sensor 122*d* cannot directly measure the temperature of water stored in the tub 122, it is not possible to measure the temperate of water stored in the tub 122.

In order to solve this problem, upon determining that water has already been stored in the tub 122, intermittent water supply is performed several times to reduce the temperature of the heated water in the tub 122, thereby preventing negative pressure from being instantaneously generated due to a large amount of water being supplied at once. N2 times may be 30 times.

The laundry treatment apparatus may include a water level sensor for transmitting electromagnetic waves (including ultrasonic waves) to water and receiving the electromagnetic waves reflected by the water.

In an example, in the case in which the level of water in the tub 122 is directly measured, the water level sensor is provided at the upper side of the tub 122 to measure the level of water stored in the tub 122. A water level frequency measured by the water level sensor is in inverse proportion to the level of water in the tub. That is, when the water level frequency is high, the level of water in the tub may be low, and when the water level frequency is low, the level of water in the tub may be high.

In another example, in the case in which the level of water in the tub 122 is indirectly measured, the water level sensor may measure the level of water in a water level pipe that is vertically provided so as to be parallel to the tub 122. The water level pipe is connected to the lower side of the tub 122. Under atmospheric pressure, the level of water in the tub 122 is equal to the level of water in the water level pipe.

At the heating step (S600), the heater 128 installed at the bottom surface of the tub 122 is driven to heat the water stored in the tub 122. In addition, at the heating step (S600), water is supplied to a first level, which is lower than a washing level for main washing. The reason for this is that a large amount of time is required to heat a large amount of water. Consequently, water is supplied into the tub 122 only to a first level at which laundry is sufficiently immersed in the water.

If the washing water supply step (S800) is performed to directly supply water to the washing level after the heating step (S600), water is introduced into the tub 122 to the washing level, which is higher than the first level, within a short time. As a result, the temperature of the water stored in the tub 122 is abruptly lowered, and the heated air in the tub 122 is abruptly condensed (i.e. contracted) due to the low-temperature water.

For this reason, high negative pressure is instantaneously generated in the tub 122. As a result, the tub door 120*a* or the tub cover 120*b* may be deformed, a gap may be formed between the tub door 120*a* and the tub cover 120*b*, or force may be applied to the tub door 120*a* such that the tub door is moved toward the inside of the tub, whereby the locking unit of the tub door 120*a* may be unlocked and thus the tub door 120*a* may open.

In order to solve this problem, the negative pressure prevention step (S700) is performed. FIG. 14 is a flowchart showing a control method for preventing negative pressure from being generated in the tub. Hereinafter, the negative pressure prevention step (S700) will be described.

At the negative pressure prevention step (S700), intermittent water supply is performed to supply water into the tub 122 for a first predetermined amount of time and to interrupt the supply of water for a second predetermined amount of time.

The first predetermined amount of time may be shorter than the second predetermined amount of time. In order words, the second predetermined amount of time may be longer than the first predetermined amount of time. For example, the first predetermined amount of time may be about 0.1 seconds, and the second predetermined amount of time may be about 2 seconds. Consequently, a small amount of water is supplied, and then waiting is performed for a relatively long time such that the heated water in the tub 122 sufficiently exchanges heat with the supplied water to achieve thermal equilibrium.

Specifically, the water supply time is shortened to supply a small amount of water into the tub such that the temperature of the heated water is not abruptly changed and such that negative pressure is not abruptly generated in the tub. However, the waiting time for which water is not supplied is long such that the water in the tub 122 sufficiently exchanges heat with the supplied water to achieve thermal equilibrium.

In the intermittent water supply, the controller 700 performs control such that the water supply valve 125*b* is open for the first predetermined amount of time in order to supply water into the tub 122 through the spray nozzle and such that the water supply valve 125*b* is closed for the second predetermined amount of time to obtain the waiting time.

For example, when the intermittent water supply is performed twice, the controller 700 performs control such that the water supply valve 125*b* is open for the first predetermined amount of time and is closed for the second predetermined amount of time, which is repeated twice.

The negative pressure prevention step (S700) includes a comparative level sensing step (S720) of performing intermittent water supply N3 times and sensing a comparative level of water and a water level comparison step (S730) of comparing the sensed initial level of water with the sensed comparative level of water.

Furthermore, the negative pressure prevention step (S700) may include an additional water supply step (S740) of further performing intermittent water supply N4 times based on the comparison result.

At the comparative level sensing step (S720), the comparative level of water in the tub 122 is sensed within the second predetermined amount of time included in each time period for intermittent water supply. Alternatively, the comparative level of water in the tub 122 is sensed after the second predetermined amount of time included in each time period for intermittent water supply.

The reason that the comparative level of water is measured after intermittent water supply at the comparative level sensing step (S720) is that negative pressure is generated in the tub due to the contraction of air caused by the abrupt change of temperature in the tub 122 only when the intermittent water supply is performed. The greater the difference between the temperature of the supplied water and the temperature of the heated water in the tub, the higher the instantaneous negative pressure that is generated in the tub. Consequently, it is possible to indirectly measure the temperature of water in the tub because it is proportional to the magnitude of the instantaneous negative pressure. When high negative pressure is generated, the level of water in the tub is instantaneously greatly changed.

In brief, the greater the difference between the comparative level of water measured during intermittent water supply and a reference level of water, the higher the negative pressure that is instantaneously generated in the tub, from which it can be seen that the water in the tub has been heated to a high temperature. Consequently, the greater the difference between the comparative level of water and the reference level of water, the more intermittent water supply is performed to reduce the temperature of water stored in the tub such that the magnitude of instantaneous negative pressure generated in the tub when water is subsequently supplied for washing is reduced.

At the comparative level sensing step (S720), N3 times may be 4 to 10 times, preferably 5 times. The reason that intermittent water supply is performed N3 times at the comparative level sensing step (S720) is that, when the comparative level of water is sensed after 1 to 3 times of intermittent water supply, the sensed comparative level of water may not reflect the level of water in the tub when a small amount of water is actually supplied into the tub. Consequently, the intermittent water supply is performed at least 5 times to set the comparative level of water to be used at the water level comparison step (S730).

The highest one of the comparative levels of water sensed N3 times is selected as the comparative level of water sensed at the water level comparison step (S730). In the case in which the level of water in the tub is indirectly measured (i.e. in the case in which the water level frequency of the water level pipe communicating with the sealed tub is measured), the level of water in the tub at which the highest one of the water level frequencies sensed during N3 times of intermittent water supply is sensed is selected as the sensed comparative level of water. The reason for this is that, when the water level frequency is highest, the level of water in the tub is highest.

At the water level comparison step (S730), the sensed comparative level of water is compared with the sensed initial level of water.

When the difference between the comparative level of water and the initial level of water is less than a predetermined value, water is directly supplied to the washing level without additional intermittent water supply, and then main washing is performed. The reason for this is that, upon determining that the difference between the initial level of water and the comparative level of water measured in the case in which negative pressure is generated in the tub 122 through previous N3 times of intermittent water supply is not great, it may be determined that the temperature of the heated water in the tub has been sufficiently lowered.

As a result, it may be determined that high negative pressure will not be generated in the tub 122 even when water is subsequently supplied for main washing. In this case, no additional water supply is performed (i.e. N4=0).

When the difference between the comparative level of water and the initial level of water exceeds the predetermined value, the number of times of additional intermittent water supply is increased. That is, N4 is not fixed but varies depending on the difference. N4 may be preset and stored in the form of a table.

In some implementations, in the case in which the method of controlling the laundry treatment apparatus is temporarily stopped or completely stopped during intermittent water supply, the negative pressure prevention step (S700) is performed again from the beginning. That is, in the case in which the laundry treatment apparatus is temporarily stopped or completely stopped during intermittent water supply, the comparative level sensing step (S720), the water level comparison step (S730), and the additional water supply step (S740) are sequentially performed.

When the laundry treatment apparatus is temporarily stopped or completely stopped, therefore, the case in which the temperature of water stored in the tub is unexpectedly changed, such as the case in which no water is supplied through the water supply unit 125, is provided for, and negative pressure is prevented from being generated in the tub.

When intermittent water supply is performed several times after the interior of the tub is heated and before washing water supply for washing is performed, followed by washing water supply, as shown in FIG. 12, negative pressure may be instantaneously generated in the tub during the washing water supply. However, the generated negative pressure is not sufficiently high to deform the tub cover or the tub door or to unlock the push/open button type locking unit of the tub door. As a result, the tub door is not opened.

In some implementations, a laundry treatment apparatus may be configured such that components in the laundry treatment apparatus are not damaged while energy is saved when a course including heating to heat water is performed.

In some implementations, a laundry treatment apparatus may be configured such that an agitation unit is not damaged even when a course including heating to heat water is performed.

In some implementations, a laundry treatment apparatus may be configured to mitigate an abrupt change in temperature of an agitation unit, thereby preventing damage to the agitation unit. The laundry treatment apparatus may be is configured to mitigate an abrupt change in temperature of an agitation unit in the case in which the agitation unit is made of materials having different coefficients of thermal expansion or includes parts having different coefficients of thermal expansion, thereby preventing damage to the agitation unit.

In some implementations, a laundry treatment apparatus may be configured to perform slow stepwise cooling an agitation unit even when the agitation unit is heated to a high temperature.

In some implementations, the laundry treatment apparatus is configured to mitigate abrupt negative pressure from being generated in a tub. The laundry treatment apparatus may be configured to mitigate abrupt negative pressure from being generated in a tub irrespective of the temperature of water supplied from the outside.

In some implementations, a laundry treatment apparatus is configured to heat wash water and perform a washing cycle.

In some implementations, a laundry treatment apparatus is configured to mitigate occurrences of a door being deformed or opened by negative pressure in a tub. The laundry treatment apparatus may be configured to mitigate instantaneously high negative pressure from being generated in a tub.

In some implementations, a laundry treatment apparatus is configured to mitigate instantaneously abrupt negative pressure from being generated in a tub due to the amount of air being greater than the amount of air flowing per unit time between the inside and the outside of the tub.

Although some examples of implementations have been illustrated and described as above, the implementations are provided to assist understanding of the present disclosure and the present disclosure is not limited to the above described particular implementations. Various modifications and variations can be made without departing from the spirit or scope of the present disclosure.

What is claimed is:

1. A laundry treatment apparatus comprising:

a cabinet defining an external appearance of the laundry treatment apparatus;

a tub configured to hold water and having an introduction port at a top of the tub through which an interior of the tub is accessible;

a drum rotatably provided in the tub and configured to receive laundry, a width of the drum being greater than a height of the drum;

a tub door configured to open and close the introduction port of the tub, the tub being substantially sealed based on the tub door closing the introduction port;

an agitation unit that protrudes upward from a center part of a bottom surface of the drum and that is configured to agitate water and laundry in the drum in a state in which the drum rotates;

a heater configured to heat water in the tub;

a water supply pipe configured to supply cold water to the tub;

a water supply valve configured to control a flow through the water supply pipe; and at least one processor configured to, in a state in which the introduction port is closed by the tub door, control the water supply valve and the heater by:

controlling the heater to heat a first amount of water in the tub to a first temperature; and intermittently controlling the water supply valve to additionally and intermittently supply, to the first amount of water that was heated to the first temperature by the heater, incremental amounts of water into the tub to reduce a difference in pressure between inside and outside of the tub.

2. The laundry treatment apparatus according to claim 1, wherein controlling the water supply valve to supply the incremental amounts of water into the tub comprises:

controlling the water supply valve to provide a supply of water through the water supply pipe into the tub for a first amount of time; and controlling the water supply valve to interrupt the supply of water through the water supply pipe into the tub for a second amount of time.

3. The laundry treatment apparatus according to claim 2, wherein the second amount of time is longer than the first amount of time.

4. The laundry treatment apparatus according to claim 2, wherein controlling the water supply valve to supply the incremental amounts of water into the tub comprises:

controlling the water supply valve to alternate, a plural number of times, between providing the supply of water through the water supply pipe into the tub for the first amount of time and controlling the water supply valve to interrupt the supply of water through the water supply pipe into the tub for the second amount of time.

5. The laundry treatment apparatus according to claim 1, wherein the at least one processor is further configured to, after controlling the water supply valve to supply the incremental amounts of water into the tub:

control the water supply valve to additionally supply a second amount of water into the tub; and control the drum to rotate inside the tub based on the second amount of water being added into the tub.

6. The laundry treatment apparatus according to claim 5, wherein the first amount of water added into the tub results in a first water level in the tub at which a portion of the agitation unit is immersed below the first water level and an uppermost end of the agitation unit is exposed above the first water level, and the second amount of water added into the tub results in a second water level in the tub at which the uppermost end of the agitation unit is immersed below the second water level.

7. The laundry treatment apparatus according to claim 6, wherein controlling the heater to heat the first amount of water in the tub to the first temperature comprises:

heating the water at the first water level in the tub to a highest temperature among available water temperature setting values provided by the laundry treatment apparatus.

8. The laundry treatment apparatus according to claim 1, wherein the agitation unit comprises a first surface that is exposed to an interior of the drum, the first surface being plated with a first material.

9. The laundry treatment apparatus according to claim 1, further comprising:

a water level sensor configured to sense a level of water in the tub, wherein the at least one processor is further configured to:

control the water supply valve to supply water into the tub at a first rate until a first time at which an uppermost end of the agitation unit is immersed below a water level of the tub; and after the first time, control the water supply valve to supply water into the tub at a second rate less than the first rate.

10. The laundry treatment apparatus according to claim 1, further comprising:

a temperature sensor configured to sense a temperature in the tub, wherein the at least one processor is configured to:

control the water supply valve to supply water into the tub at a first rate until a first time at which a temperature sensed by the temperature sensor satisfies a first condition; and after the first time, control the water supply valve to supply water into the tub at a second rate less than the first rate.

11. The laundry treatment apparatus according to claim 1, wherein the at least one processor is further configured to control the water supply valve and the heater by:

while controlling the water supply valve to supply the incremental amounts of water into the tub, intermittently controlling the heater to heat the incremental amounts of water that are added into the tub.

12. A method of controlling a laundry treatment apparatus comprising a tub configured to hold wash water, a drum provided in the tub and configured to receive laundry, a width of the drum being greater than a height of the drum, an introduction port formed in an upper part of the tub through which an interior of the tub is accessible, and a tub door configured to open and close the introduction port, the tub being substantially sealed based on the tub door closing the introduction port, the method comprising:

heating a first amount of water in the tub to a first temperature;

additionally and intermittently supplying, to the first amount of water that was heated to the first temperature, incremental amounts of water into the tub to reduce a difference in pressure between inside and outside of the tub; and rotating the drum to agitate laundry and water inside the drum.

13. The method according to claim 12, wherein rotating the drum to agitate the laundry and the water inside the drum is performed after the incremental amounts of water are additionally supplied to the first amount of water that was heated to the first temperature.

14. The method according to claim 12, further comprising:

sensing an initial level of water in the tub before the first amount of water in the tub is heated to the first temperature; and selectively supplying the incremental amounts of water to the first amount of water that was heated to the first temperature based on the sensed initial level of water.

15. The method according to claim 14, wherein a number of times in which the incremental amounts of water are added to the first amount of water depends on whether the sensing of the initial level of water in the tub is performed.

16. The method according to claim 12, further comprising:

supplying the first amount of water into the tub that is to be heated to the first temperature, measuring an initial temperature of the first amount of water prior to heating the first amount of water to the first temperature.

17. The method according to claim 16, wherein a number of times in which the incremental amounts of water are added to the first amount of water depends on the measured initial temperature of the first amount of water.

18. The method according to claim 12, wherein additionally supplying, to the first amount of water that was heated to the first temperature, the incremental amounts of water into the tub comprises:

performing intermittent water supply a first number of times; and measuring a change in a level of water in the tub.

19. The method according to claim 18, further comprising:

based on a determination that the change in the level of water in the tub is greater than a threshold value, performing additional intermittent water supply.

20. The method according to claim 12, wherein:

the laundry treatment apparatus further comprises a water supply pipe configured to supply water into the tub, a water supply valve configured to control a flow through the water supply pipe, and a heater configured to heat water in the tub, and wherein a first duration of time for heating the first amount of water in the tub to the first temperature is greater than a second duration of time for additionally supplying the incremental amounts of water into the tub and for rotating the drum to agitate the laundry and the water inside the drum.

* * * * *